US012187967B2

(12) United States Patent
Koc-Karabocek et al.

(10) Patent No.: US 12,187,967 B2
(45) Date of Patent: Jan. 7, 2025

(54) PROCESSES AND SYSTEMS FOR QUENCHING PYROLYSIS EFFLUENTS

(71) Applicant: ExxonMobil Chemical Patents Inc., Baytown, TX (US)

(72) Inventors: Reyyan Koc-Karabocek, Kingwood, TX (US); James R. Lattner, La Porte, TX (US); William A. Aslaner, League City, TX (US); David Spicer, Houston, TX (US); Mark A. Rooney, Pasadena, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 32 days.

(21) Appl. No.: 17/768,663

(22) PCT Filed: Sep. 16, 2020

(86) PCT No.: PCT/US2020/051090
§ 371 (c)(1),
(2) Date: Apr. 13, 2022

(87) PCT Pub. No.: WO2021/086509
PCT Pub. Date: May 6, 2021

(65) Prior Publication Data

US 2024/0110110 A1 Apr. 4, 2024

Related U.S. Application Data

(60) Provisional application No. 62/929,326, filed on Nov. 1, 2019.

(30) Foreign Application Priority Data

Jan. 14, 2020 (EP) ..... 20151752

(51) Int. Cl.
*C10G 70/04* (2006.01)
*C10G 69/06* (2006.01)

(52) U.S. Cl.
CPC ..... *C10G 70/04* (2013.01); *C10G 69/06* (2013.01); *C10G 2300/202* (2013.01);
(Continued)

(58) Field of Classification Search
CPC ..... C10G 70/04; C10G 69/06; C10G 2300/202; C10G 2300/308; C10G 2300/4006;
(Continued)

(56) References Cited

U.S. PATENT DOCUMENTS 3,163,496 A 12/1964 Jahnig et al. ..... 23/212
3,661,543 A 5/1972 Saxton ..... 48/206
(Continued)

FOREIGN PATENT DOCUMENTS

TW 2016/02330 1/2016 ..... C10G 51/02
WO WO2018/111574 6/2018 ..... C10G 45/00
(Continued)

*Primary Examiner* — Randy Boyer
*Assistant Examiner* — Juan C Valencia

(57) ABSTRACT

Processes and systems for quenching an effluent. In certain embodiments, the process can include contacting a pyrolysis effluent and a first quench medium to produce a first quenched effluent. A bottoms stream that can include tar and an overhead stream that can include ethylene and propylene can be obtained from the first quenched effluent. The first quench medium can include a first portion of the bottoms stream that can include a first portion of the tar. In certain embodiments, the process can also include hydroprocessing a second portion of the bottoms stream that can include a second portion of the tar to produce a hydroprocessed product. A hydroprocessed bottoms stream can be obtained from the hydroprocessed product. In certain embodiments, the process can also include contacting at least a portion of
(Continued)

the hydroprocessed bottoms stream and the first portion of the bottoms stream to produce the first quench medium.

27 Claims, 4 Drawing Sheets

(52) U.S. Cl.
CPC ..... *C10G 2300/308* (2013.01); *C10G 2300/4006* (2013.01); *C10G 2300/4081* (2013.01); *C10G 2400/20* (2013.01)

(58) Field of Classification Search
CPC ..... C10G 2300/4081; C10G 2400/20; C10G 9/005; C10G 9/16; C10G 9/36; C10G 70/00
See application file for complete search history.

(56) References Cited

U.S. PATENT DOCUMENTS

| | | | | |
|---|---|---|---|---|
| 3,702,516 | A | 11/1972 | Luckenbach | 48/206 |
| 3,759,676 | A | 9/1973 | Lahn | 48/206 |
| 3,816,084 | A | 6/1974 | Moser et al. | 48/206 |
| 4,150,716 | A | 4/1979 | Ozaki et al. | 165/1 |
| 4,213,848 | A | 7/1980 | Saxton | 208/127 |
| 4,233,137 | A | 11/1980 | Ozaki et al. | 208/48 |
| 4,269,696 | A | 5/1981 | Metrailer | 208/120 |
| 4,323,446 | A | 4/1982 | Chervenak et al. | 208/8 |
| 4,828,681 | A | 5/1989 | Yourtee et al. | 208/127 |
| 5,443,715 | A | 8/1995 | Grenoble et al. | 208/95 |
| 5,472,596 | A | 12/1995 | Kerby et al. | 208/127 |
| 5,952,539 | A | 9/1999 | Seimandi et al. | 585/648 |
| 6,179,993 | B1 | 1/2001 | Seimandi et al. | 208/27 |
| 6,419,885 | B1 | 7/2002 | Di Nicolantonio et al. | 422/198 |
| 6,632,351 | B1 | 10/2003 | Ngan et al. | 208/132 |
| 6,860,985 | B2 | 3/2005 | Siskin et al. | 208/48 |
| 7,090,765 | B2 | 8/2006 | Spicer et al. | 208/130 |
| 7,097,758 | B2 | 8/2006 | Stell et al. | 208/48 |
| 7,138,047 | B2 | 11/2006 | Stell et al. | 208/130 |
| 7,220,887 | B2 | 5/2007 | Stell et al. | 585/647 |
| 7,235,705 | B2 | 6/2007 | Stell | 585/647 |
| 7,244,871 | B2 | 7/2007 | Stell et al. | 585/648 |
| 7,247,765 | B2 | 7/2007 | Stell et al. | 585/652 |
| 7,297,833 | B2 | 11/2007 | Beattie et al. | 585/652 |
| 7,311,746 | B2 | 12/2007 | Stell et al. | 55/419 |
| 7,312,371 | B2 | 12/2007 | Stell et al. | 585/652 |
| 7,351,872 | B2 | 4/2008 | Stell et al. | 585/652 |
| 7,488,459 | B2 | 2/2009 | Stell et al. | 422/198 |
| 7,578,929 | B2 | 8/2009 | Stell et al. | 208/130 |
| 7,780,843 | B2 | 8/2010 | Strack et al. | 208/48 |
| 7,820,035 | B2 | 10/2010 | McCoy et al. | 208/132 |
| 7,914,668 | B2 | 3/2011 | Siskin et al. | 208/131 |
| 7,993,435 | B2 | 8/2011 | Stell et al. | 96/293 |
| 8,083,931 | B2 | 12/2011 | McCoy et al. | 208/67 |
| 8,101,066 | B2 | 1/2012 | Siskin et al. | 208/126 |
| 8,147,676 | B2 | 4/2012 | Siskin et al. | 208/50 |
| 8,177,200 | B2 | 5/2012 | Spicer et al. | 261/153 |
| 8,361,311 | B2 | 1/2013 | Davis et al. | 208/126 |
| 8,496,805 | B2 | 7/2013 | Sabottke et al. | 208/131 |
| 9,090,836 | B2 | 7/2015 | Brown et al. | C10G 69/06 |
| 9,139,781 | B2 | 9/2015 | Bernatz et al. | C10G 9/005 |
| 9,637,694 | B2 | 5/2017 | Evans et al. | C10G 69/06 |
| 9,670,417 | B2 | 6/2017 | Du et al. | C10G 9/32 |
| 9,777,227 | B2 | 10/2017 | Soultanidis et al. | C10G 49/00 |
| 10,400,177 | B2 | 9/2019 | Le et al. | C10B 55/10 |
| 10,421,915 | B2 | 9/2019 | Reiner et al. | C10G 9/005 |
| 2008/0221378 | A1 | 9/2008 | Stell et al. | 585/804 |
| 2012/0012581 | A1 | 1/2012 | Schumaker et al. | 220/6 |
| 2014/0061100 | A1* | 3/2014 | Lattner | C10G 31/06 208/48 Q |
| 2015/0315494 | A1 | 11/2015 | Hanks et al. | C10G 69/02 |
| 2019/0016969 | A1 | 1/2019 | Kandel et al. | |

FOREIGN PATENT DOCUMENTS

| | | | |
|---|---|---|---|
| WO | WO-2018128983 A1 * | 7/2018 | C01B 3/00 |
| WO | WO2019/164673 | 8/2019 | C10G 9/00 |

* cited by examiner

PROCESSES AND SYSTEMS FOR QUENCHING PYROLYSIS EFFLUENTS

CROSS-REFERENCE TO RELATED APPLICATIONS

This application is a US national phase application of PCT Application Serial No. PCT/US2020/051090 having a filing date of Sep. 16, 2020, which claims priority to and the benefit of U.S. Provisional Application No. 62/929,326 having a filing date of Nov. 1, 2019 and European Patent Application No. 20151752.1 having a filing date of Jan. 14, 2020, the disclosures of all of which are incorporated herein by reference in their entireties.

FIELD

This disclosure relates to processes and systems for converting a hydrocarbon-containing feed via pyrolysis. More particularly, this disclosure relates to processes and systems for quenching pyrolysis effluents.

BACKGROUND

Pyrolysis processes, e.g., steam cracking, convert saturated hydrocarbons to higher-value products, e.g., light olefins such as ethylene and propylene. In addition to these higher-value products, however, the pyrolysis process also produces a significant amount of relatively low-value heavy products, such as pyrolysis tar. Pyrolysis tar is a high-boiling, viscous, reactive material comprising complex, ringed and branched molecules that can polymerize and foul equipment. Pyrolysis tar also contains high molecular weight non-volatile components including paraffin insoluble compounds, such as pentane-insoluble compounds and heptane-insoluble compounds.

One difficulty encountered in pyrolysis processes is the reactive composition of the pyrolysis effluent. The pyrolysis effluent contains a significant amount of reactive free radicals formed during the high temperature pyrolysis of hydrocarbon-containing feeds. As the pyrolysis effluent cools, some of the reactive free radicals react to form stable products. However, some radicals survive and act as initiators for olefin polymerization in that can cause fouling.

Generally the pyrolysis effluent recovered from a pyrolysis process, such as steam cracking, is quenched by indirectly transferring heat from the pyrolysis effluent to a quench fluid, e.g., water and/or steam, in an indirect heat exchanger, i.e., a transfer line exchanger. The primary purpose of the transfer line exchanger is to rapidly quench the pyrolysis effluent to stop the unselective cracking reactions as soon as the effluent leaves the radiant section of the pyrolysis furnace and at the same time recover the energy at the highest usable level. The dew point of the pyrolysis effluent is greater than an inner wall or inner surface temperature of the transfer line exchanger. As a result, the heaviest fraction of the pyrolysis effluent (tar) condenses on the inner-wall of the transfer line exchanger and turns into coke over time. This coke deposition on the inner surfaces of the transfer line exchanger rapidly reduces the heat transfer efficiency of the transfer line exchanger. As the transfer line exchanger efficiency decreases due to coke accumulation, the outlet temperature of the transfer line exchanger increases, which leads to reduced heat recover. Once the transfer line exchanger outlet temperature approaches the design temperature of the downstream piping, the pyrolysis furnace and the transfer line exchanger must be decoked.

There is a need, therefore, for improved processes and systems for reducing fouling during quenching of pyrolysis effluents. This disclosure satisfies this and other needs.

SUMMARY

The present inventors have devised processes and systems for quenching pyrolysis effluents. In some embodiments, the process can include contacting a pyrolysis effluent and a first quench medium to produce a first quenched effluent. A bottoms stream that can include tar and an overhead stream that can include ethylene and propylene can be obtained from the first quenched effluent. The first quench medium can include a first portion of the bottoms stream that can include a first portion of the tar.

In some embodiments, the process can include contacting a pyrolysis effluent and a first quench medium to produce a first quenched effluent. A bottoms stream that can include tar and an overhead stream that can include ethylene and propylene can be obtained from the first quenched effluent. The first quench medium can include a first portion of the bottoms stream that can include a first portion of the tar. A second portion of the bottoms stream that can include a second portion of the tar can be hydroprocessed to produce a hydroprocessed product. A hydroprocessed bottoms stream can be obtained from the hydroprocessed product. At least a portion of the hydroprocessed bottoms stream and the first portion of the bottoms stream can be contacted to produce the first quench medium.

In some embodiments, the process for quenching an effluent can include obtaining a vapor phase product and a liquid phase product from a heated mixture comprising steam and a hydrocarbon-containing feed. The vapor phase product can be steam cracked to produce a pyrolysis effluent. The pyrolysis effluent having a first temperature and a first quench medium can be contacted to produce a first quenched effluent having a second temperature. Heat can be indirectly transferred from the first quenched effluent to a second quench medium to produce a second quenched effluent having a third temperature and a heated second quench medium. Heat can be indirectly transferred from the second quenched effluent to a third quench medium or the second quenched effluent can be contacted with a third quench medium to produce a third quenched effluent having a fourth temperature. A bottoms stream that can include tar and an overhead stream that can include ethylene, propylene, and a quench oil can be obtained from the third quenched effluent. A first portion of the bottoms stream that can include the tar can be recycled as the first quench medium. In some embodiments, the process can also include hydroprocessing a second portion of the bottoms stream that can include a second portion of the tar to produce a hydroprocessed product. In some embodiments, the process can also include recycling a first portion of the hydroprocessed product as the first quench medium.

In some embodiments, the system for converting a hydrocarbon-containing feed by pyrolysis can include a first vapor-liquid separator, a pyrolysis reactor, a quenching section, a second vapor-liquid separator, and a first conduit. The first vapor-liquid separator can be adapted for receiving a hydrocarbon-containing feed, separating the hydrocarbon-containing feed into a first vapor phase hydrocarbon stream and a first liquid phase hydrocarbon stream, discharging the first vapor phase hydrocarbon stream, and discharging the first liquid phase hydrocarbon stream. The pyrolysis reactor can be adapted for receiving the first vapor phase hydrocarbon stream, heating the first vapor phase hydrocarbon stream to effect pyrolysis of at least a portion of the first vapor phase hydrocarbon stream, and discharging a pyrolysis effluent stream. The quenching section can be adapted for receiving the pyrolysis effluent stream, quenching the pyrolysis effluent stream, and discharging a quenched pyrolysis effluent stream. The second vapor-liquid separator can be adapted for receiving the quenched pyrolysis effluent stream, separating the quenched pyrolysis effluent stream to obtain a second vapor phase hydrocarbon stream comprising olefins and a second liquid phase hydrocarbon stream comprising tar, discharging the second vapor phase hydrocarbon stream, and discharging the second liquid phase hydrocarbon stream. The first conduit can be adapted for transporting a first portion of the second liquid phase hydrocarbon stream comprising a first portion of the tar to the quenching section such that the first portion of the second liquid phase hydrocarbon stream contacts the pyrolysis effluent to produce a mixture comprising the first portion of the second liquid phase hydrocarbon stream and the pyrolysis effluent. In some embodiments, the system can also include a hydroprocessing unit, a third vapor-liquid separator, and a second conduit. The hydroprocessing unit can be adapted for receiving a second portion of the second liquid phase hydrocarbon stream comprising a second portion of the tar and optionally at least a portion of the first liquid phase hydrocarbon stream, hydroprocessing the second portion of the second liquid phase hydrocarbon stream and optionally the at least a portion of the first liquid phase hydrocarbon stream under hydroprocessing conditions to produce a hydroprocessed product, and discharging the hydroprocessed product. The third vapor-liquid separator can be adapted for separating a hydroprocessed overhead stream comprising at least 1 wt % of the hydroprocessed product, a hydroprocessed mid-cut stream comprising at least 20 wt % of the hydroprocessed product; and a hydroprocessed bottoms stream comprising at least 20 wt % of the hydroprocessed product. The second conduit can be adapted for transferring at least a portion of the hydroprocessed bottoms stream from the separator to the quenching section such that the hydroprocessed bottoms stream contacts the pyrolysis effluent to produce a mixture comprising the first portion of the second liquid phase hydrocarbon stream, the pyrolysis effluent, and the hydroprocessed bottoms stream.

DETAILED DESCRIPTION

Figure 1:
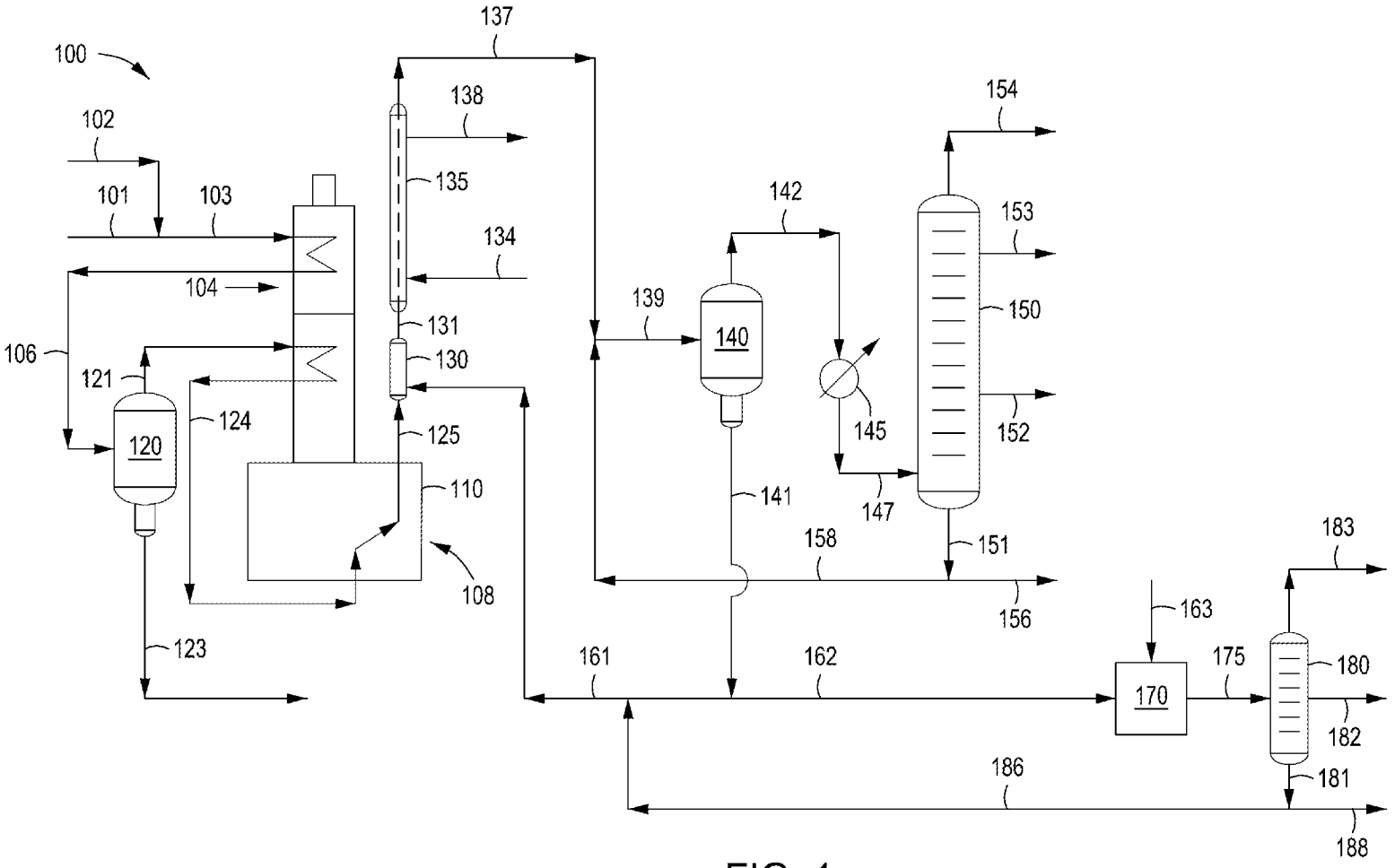
FIG. 1 depicts an illustrative system for converting a hydrocarbon-containing feed by pyrolysis to produce a pyrolysis effluent and quenching the pyrolysis effluent via first quenching configuration, according to one or more embodiments described.

Various specific embodiments, versions and embodiments of the invention will now be described, including preferred embodiments and definitions that are adopted herein for purposes of understanding the claimed invention. While the following detailed description gives specific preferred embodiments, those skilled in the art will appreciate that these embodiments are exemplary only, and that the invention may be practiced in other ways. For purposes of determining infringement, the scope of the invention will refer to any one or more of the appended claims, including their equivalents, and elements or limitations that are equivalent to those that are recited. Any reference to the "invention" may refer to one or more, but not necessarily all, of the inventions defined by the claims.

In this disclosure, a process is described as comprising at least one "step." It should be understood that each step is an action or operation that may be carried out once or multiple times in the process, in a continuous or discontinuous fashion. Unless specified to the contrary or the context clearly indicates otherwise, multiple steps in a process may be conducted sequentially in the order as they are listed, with or without overlapping with one or more other steps, or in any other order, as the case may be. In addition, one or more or even all steps may be conducted simultaneously with regard to the same or different batch of material. For example, in a continuous process, while a first step in a process is being conducted with respect to a raw material just fed into the beginning of the process, a second step may be carried out simultaneously with respect to an intermediate material resulting from treating the raw materials fed into the process at an earlier time in the first step. Preferably, the steps are conducted in the order described.

Unless otherwise indicated, all numbers indicating quantities in this disclosure are to be understood as being modified by the term "about" in all instances. It should also be understood that the precise numerical values used in the specification and claims constitute specific embodiments. Efforts have been made to ensure the accuracy of the data in the examples. However, it should be understood that any measured data inherently contains a certain level of error due to the limitation of the technique and/or equipment used for acquiring the measurement.

Certain embodiments and features are described herein using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated.

As used herein, the indefinite article "a" or "an" shall mean "at least one" unless specified to the contrary or the context clearly indicates otherwise. Thus, embodiments using "a pyrolysis reactor" include embodiments where one, two or more pyrolysis reactors are used, unless specified to the contrary or the context clearly indicates that only one pyrolysis reactor is used.

"Crude" or "crude oil" in this disclosure interchangeably means whole crude oil as it issues from a wellhead, production field facility, transportation facility, or other initial field processing facility, and/or crude that has been processed by a step of desalting, treating, and/or other steps as may be necessary to render it acceptable for conventional distillation in a refinery. Crude as used herein is presumed to contain resid.

"Crude fractions" as used herein mean hydrocarbon fractions obtainable from fractionation of a crude.

"Resid" as used herein refers to (i) the bottoms cut of a crude distillation process that contains non-volatile components, and/or (ii) a material comprising organic compounds such as hydrocarbons having boiling points in the boiling point range of a resid in category (i). Resids of category (i) are complex mixture of heavy petroleum compounds otherwise known in the art as residuum or residual. Atmospheric resid is the bottoms product produced from atmospheric distillation of a crude where a typical endpoint of the heaviest distilled product is nominally 650° F. (343° C.), and is referred to as 650° F. (343° C.) resid. The term "nominally" herein means that reasonable experts may disagree on the exact cut point for these terms, but by no more than +/−100° F. (+/−55.6° C.) preferably no more than +/−50° F. (+/−27.8° C.). Vacuum resid is the bottoms product from a distillation column operated under vacuum where the heaviest distilled product can be nominally 1050° F. (566° C.), and is referred to as 1050° F. (566° C.) resid. This 1050° F. (566° C.) portion contains high concentration of asphaltenes, which traditionally are considered to be problematic for the steam cracker, resulting in severe fouling and potentially corrosion or erosion of the apparatus. Vacuum resid can be advantageously mixed with a crude, and/or a lighter crude fraction such as an atmospheric resid to form a suitable feed supplied to the flashing drum of the process of this disclosure. Category (ii) resid in this disclosure can include, e.g., (a) natural or synthetic polymer materials, such as polyethylene, polypropylene, polystyrene, polyvinyl chloride, and the like; (b) biofuel (e.g., biodiesel) derived from biological materials (e.g., lignin, plant waste, algae waste, and food waste); (c) biological materials such as algae, corn, soy; and (d) any mixture of one or more of (a), (b), and/or (c).

The term "hydrocarbon" as used herein means (i) any compound consisting of hydrogen and carbon atoms or (ii) any mixture of two or more such compounds in (i). The term "Cn hydrocarbon," where n is a positive integer, means (i) any hydrocarbon compound comprising carbon atom(s) in its molecule at the total number of n, or (ii) any mixture of two or more such hydrocarbon compounds in (i). Thus, a C2 hydrocarbon can be ethane, ethylene, acetylene, or mixtures of at least two of these compounds at any proportion. A "Cm to Cn hydrocarbon" or "Cm-Cn hydrocarbon," where m and n are positive integers and m<n, means any of Cm, Cm+1, Cm+2, Cn−1, Cn hydrocarbons, or any mixtures of two or more thereof. Thus, a "C2 to C3 hydrocarbon" or "C2-C3 hydrocarbon" can be any of ethane, ethylene, acetylene, propane, propene, propyne, propadiene, cyclopropane, and any mixtures of two or more thereof at any proportion between and among the components. A "saturated C2-C3 hydrocarbon" can be ethane, propane, cyclopropane, or any mixture thereof of two or more thereof at any proportion. A "Cn+ hydrocarbon" means (i) any hydrocarbon compound comprising carbon atom(s) in its molecule at the total number of at least n, or (ii) any mixture of two or more such hydrocarbon compounds in (i). A "Cn− hydrocarbon" means (i) any hydrocarbon compound comprising carbon atoms in its molecule at the total number of at most n, or (ii) any mixture of two or more such hydrocarbon compounds in (i). A "Cm hydrocarbon stream" means a hydrocarbon stream consisting essentially of Cm hydrocarbon(s). A "Cm-Cn hydrocarbon stream" means a hydrocarbon stream consisting essentially of Cm-Cn hydrocarbon(s).

The term "non-volatile components" as used herein refers to the fraction of a petroleum feed having a nominal boiling point of at least 590° C., as measured by ASTM D6352-15 or D-2887-18. Non-volatiles include coke precursors, which are large, condensable molecules that condense in the vapor and then form coke during pyrolysis of the petroleum feed.

The term "olefin product", as used herein, means a product that includes an olefin, preferably a product consisting essentially of an olefin. An olefin product in the meaning of this disclosure can be, e.g., an ethylene stream, a propylene stream, a butylene stream, an ethylene/propylene mixed stream, and the like.

The term "consisting essentially of" as used herein means the composition, feed, or effluent comprises a given component at a concentration of at least 60 wt %, preferably at least 70 wt %, more preferably at least 80 wt %, more preferably at least 90 wt %, still more preferably at least 95 wt %, based on the total weight of the composition, feed, or effluent in question.

The terms "channel" and "line" are used interchangeably and mean any conduit configured or adapted for feeding, flowing, and/or discharging a gas, a liquid, and/or a fluidized solids feed into the conduit, through the conduit, and/or out of the conduit, respectively. For example, a composition can be fed into the conduit, flow through the conduit, and/or discharge from the conduit to move the composition from a first location to a second location. Suitable conduits can be or can include, but are not limited to, pipes, hoses, ducts, tubes, and the like.

In this disclosure, a "reactor" includes a reaction vessel in which intended chemical reactions occur to convert a feed into a product mixture, and any equipment peripheral to the reaction vessel such as feed pre-conditioning equipment (heat exchangers, compressors, purification equipment, and the like), product mixture processing equipment (heat exchangers, compressors, separation equipment including but not limited to distillation columns, and the like), recycle management equipment (heat exchangers, compressors, and the like), reboiler, condenser, catalyst regeneration equipment, pump(s), valves, meters, and the like. Thus, a reactor can be understood as a reactor unit, or a reactor sub-system.

As used herein, "wt %" means percentage by weight, "vol %" means percentage by volume, "mol %" means percentage by mole, "ppm" means parts per million, and "ppm wt" and "wppm" are used interchangeably to mean parts per million on a weight basis. All concentrations herein are expressed on the basis of the total amount of the composition in question. Thus, the concentrations of the various components of the "petroleum feed" are expressed based on the total weight of the petroleum feed. All ranges expressed herein should include both end points as two specific embodiments unless specified or indicated to the contrary.

Nomenclature of elements and groups thereof used herein are pursuant to the Periodic Table used by the International Union of Pure and Applied Chemistry after 1988. An example of the Periodic Table is shown in the inner page of the front cover of Advanced Inorganic Chemistry, 6$^{th}$ Edition, by F. Albert Cotton et al. (John Wiley & Sons, Inc., 1999).

The hydrocarbon-containing feed or simply the hydrocarbon feed can be, can include, or can be derived from petroleum, plastic material, natural gas condensate, landfill gas (LFG), biogas, coal, biomass, bio-based oils, rubber, or any mixture thereof. In certain embodiments, the hydrocarbon-containing feed can include a non-volatile component.

In certain embodiments, the petroleum can be or can include any crude or any mixture thereof, any crude fraction or any mixture thereof, or any mixture of any crude with any crude fraction. A typical crude includes a mixture of hydrocarbons with varying carbon numbers and boiling points. Thus, by using conventional atmospheric distillation and vacuum distillation, one can produce a range of fuel products with varying boiling points, e.g., naphtha, gasoline, kerosene, distillate, and tar. It is highly desired, however, to convert the large hydrocarbon molecules contained in the crude into more valuable, lighter products including but not limited to ethylene, propylene, butylenes, and the like, which can be further made into more valuable products such as polyethylene, polypropylene, ethylene-propylene copolymers, butyl rubbers, and the like.

In certain embodiments, the petroleum can be or can include: crude oil, atmospheric resid, vacuum resid, steam cracked gas oil and residue, gas oil, heating oil, hydrocrackate, atmospheric pipestill bottoms, vacuum pipestill streams including bottoms, gas oil condensate, heavy non-virgin hydrocarbon stream from refineries, vacuum gas oil, heavy gas oil, naphtha, naphtha contaminated with crude, heavy residue, C4's/residue admixture, naphtha/residue admixture, hydrocarbon gases/residue admixture, hydrogen/residue admixture, gas oil/residue admixture, or any mixture thereof. Non-limiting examples of crudes can be, or can include, but are not limited to, Tapis, Murban, Arab Light, Arab Medium, and/or Arab Heavy.

In certain embodiments, the plastic material can be, or can include, but is not limited to, polyethylene terephthalate (PETE or PET), polyethylene (PE), polypropylene (PP), polyvinyl chloride (PVC), polyvinylidene chloride (PVDC), polystyrene (PS), polycarbonate (PC), polylactic acid (PLA), acrylic (PMMA), acetal (polyoxymethylene, POM), acrylonitrile-butadiene-styrene (ABS), fiberglass, nylon (polyamides, PA), polyester (PES) rayon, polyoxybenzylmethylenglycolanhydride (bakelite), polyurethane (PU), polyepoxide (epoxy), or any mixture thereof. The rubber can be or can include natural rubber, synthetic rubber, or a mixture thereof. In certain embodiments, the biogas can be produced via anaerobic digestion, e.g., the biogas produced during the anaerobic digestion of sewage. In certain embodiments, the biobased oil can be or can include oils that can degrade biologically over time. In certain embodiments, the biobased oil can be degraded via processes of bacterial decomposition and/or by the enzymatic biodegradation of other living organisms such as yeast, protozoans, and/or fungi. Biobased oils can be derived from vegetable oils, e.g., rapeseed oil, castor oil, palm oil, soybean oil, sunflower oil, corn oil, hemp oil, or chemically synthesized esters. In certain embodiments, the biomass can be or can include, but is not limited to, wood, agricultural residues such as straw, stover, cane trash, and green agricultural wastes, agro-industrial wastes such as sugarcane bagasse and rice husk, animal wastes such as cow manure and poultry litter, industrial waste such as black liquor from paper manufacturing, sewage, municipal solid waste, food processing waste, or any mixture thereof.

If the hydrocarbon-containing feed includes material that is solid at room temperature, e.g., plastic material, biomass, coal, and/or rubber, the solid material can be reduced to any desired particle size via well-known processes. For example, if the hydrocarbon-containing feed includes solid material, the solid material can be ground, crushed, pulverized, other otherwise reduced into particles that have any desired average particle size. In certain embodiments, the solid matter can be reduced to an average particle size that can be submicron or from about 1 μm, about 10 μm or about 50 μm to about 100 μm, about 150 μm, or about 200 μm. For example, the average particle size of the solid material can range from about 75 μm to about 475 μm, from about 125 μm to about 425 μm, or about 175 μm to about 375 μm.

In certain embodiments, the hydrocarbon-containing feed can include one or more crude oils or a fraction thereof and one or more plastic materials. In certain embodiments, the hydrocarbon-containing feed can include petroleum and one or more plastic materials, the one or more plastic materials present in an amount in a range of from 1 wt %, 3 wt %, 5 wt %, 7 wt %, 10 wt %, or 15 wt % to 20 wt %, 25 wt %, 30 wt %, 35 wt %, 40 wt %, or 45 wt %, based on the total weight of the hydrocarbon-containing feed.

The petroleum, e.g., crude oil or fraction thereof, can act as a solvent for the plastic material and cause at least a portion of the plastic material to dissolve in the crude oil or fraction thereof. In certain embodiments, at least 30 wt %, at least 40 wt %, at least 50 wt %, at least 60 wt %, at least 70 wt %, at least 80 wt %, at least 90 wt %, or even 100 wt % of the plastic material mixed with the crude oil or fraction thereof can be solubilized in the crude oil or fraction thereof. As such, in certain embodiments, when the hydrocarbon-containing feed includes one or more plastic materials, the hydrocarbon-containing feed can be in the form of a solution in which the plastic material is homogeneously dispersed in the crude oil or fraction thereof.

The terms "pyrolysis tar" and "tar" are used interchangeably and refer to (a) a mixture of hydrocarbons having one or more aromatic components and optionally (b) non-aromatic and/or non-hydrocarbon molecules, the mixture being derived from hydrocarbon pyrolysis, with at least 70 wt % of the mixture having a boiling point at atmospheric pressure of at least 290° C. Certain pyrolysis tars have an initial boiling point of at least 200° C. For certain pyrolysis tars, at least 80 wt %, at least 85 wt %, or at least 90 wt % of the pyrolysis tar has a boiling point at atmospheric pressure of at least 290° C. The pyrolysis tar can include, e.g., at least 50 wt %, at least 75 wt %, or at least 90 wt % of hydrocarbon molecules (including mixtures and aggregates thereof) having (i) one or more aromatic components and (ii) a number of carbon atoms of at least 15, based on the weight of the pyrolysis tar. Pyrolysis tar generally has a metals content of $1\times10^3$ ppmw or less, based on the weight of the pyrolysis tar, which is an amount of metals that is far less than that found in crude oil (or crude oil components) of the same average viscosity. The terms "steam cracker tar" and "SCT" refer to pyrolysis tar obtained from steam cracking. The term "biomass pyrolysis tar" refers to pyrolysis tar obtained from thermal cracking of biomass. The term "coal pyrolysis tar" refers to pyrolysis tar obtained from thermal cracking of hydrocarbons derived from coal.

Quenching the Pyrolysis Effluent

A pyrolysis effluent and a quench medium or first quench medium can be mixed, blended, combined, or otherwise contacted with one another to produce a quenched effluent or first quenched effluent. In certain embodiments, the pyrolysis effluent can be at a temperature of at least 750° C., e.g., 775° C. to 1,100° C., when initially contacted with the first quench medium. In certain embodiments, the first quenched effluent can be subjected to one or more additional quenching stages, e.g., indirect transfer of heat, via direct contact with one or more additional quench mediums, or a combination thereof, to produce a cooled or quenched effluent having a temperature of 250° C. to 350° C., e.g., 300° C. The cooled or quenched effluent can be introduced into one or more separation stages, e.g., a tar knock out drum, to separate a bottoms stream that can include tar and an overhead stream that can include ethylene, propylene, quench oil, and other light hydrocarbons relative to the bottoms stream. In certain embodiments, suitable separation stages can include those disclosed in U.S. Pat. No. 8,083,931.

Surprisingly and unexpectedly it has been discovered that upon exiting the pyrolysis reactor the pyrolysis effluent can be contacted with a first portion of the bottoms stream that includes a first portion of the tar as the first quench medium. In other words, the first quench medium can be or can include, but is not limited to, the first portion of the bottoms stream obtained from the quenched effluent. The tar contained in the first portion of the bottoms stream that can make up at least a portion of the first quench medium can be referred to as virgin tar or non-upgraded tar, i.e., tar not subjected to any upgrading process, e.g., hydroprocessing, once separated from the quenched pyrolysis effluent. Without wishing to be bound by theory, it is believed that the virgin tar in the first portion of the bottoms stream can be used as the quench medium because a portion or fraction thereof will remain in the liquid state upon contact with the pyrolysis effluent.

In certain embodiments, a second portion of the bottoms stream that includes a second portion of the tar can be subjected to hydroprocessing conditions sufficient to produce a hydroprocessed product. A hydroprocessed bottoms stream can be separated or otherwise obtained from the hydroprocessed product. It should be understood that the first portion of the bottoms stream that includes the first portion of the tar and the second portion of the bottoms stream that includes the second portion of the tar can have the same or substantially the same composition.

In certain embodiments, upon exiting the pyrolysis reactor the pyrolysis effluent can be contacted with at least a portion of the hydroprocessed bottoms stream and the first portion of the bottoms stream that includes the first portion of the tar as the first quench medium. In other words, the first quench medium can be or can include, but is not limited to, the first portion of the bottoms stream that includes the first portion of the tar or a mixture of the first portion of the bottoms stream and the first portion of the hydroprocessed bottoms stream.

In certain embodiments, when the first quench medium includes the first portion of the bottoms stream that includes the first portion of the tar and the first portion of the hydroprocessed bottoms stream, the first quench medium can include 1 wt %, 5 wt %, 10 wt %, 20 wt %, 30 wt %, 40 wt %, or 45 wt % to 55 wt %, 60 wt %, 70 wt %, 80 wt %, 90 wt %, 95 wt %, or 99 wt % of the first portion of the hydroprocessed bottoms stream, based on the combined weight of the first portion of the bottoms stream and the first portion of the hydroprocessed bottoms stream. In certain other embodiments, the first quench medium can include 10 wt % to 90 wt %, 20 wt % to 80 wt %, 30 wt % to 70 wt %, 40 wt % to 60 wt %, 40 wt % to 50 wt %, 45 wt % to 55 wt %, or 50 wt % to 60 wt % of the first portion of the hydroprocessed bottoms stream, based on the combined weight of the first portion of the bottoms stream and the first portion of the hydroprocessed bottoms stream. In certain embodiments, a weight ratio of the first quench medium to the pyrolysis effluent that can be used to produce the first quenched effluent can be 1:1, 1.3:1, 1.5:1, or 1.7:1 to 2:1, 2.5:1, 3:1, or 3.5:1.

The first portion of the bottoms stream that includes the first portion of the tar can include 2 wt %, 2.5 wt %, 3 wt %, or 3.5 wt % to 4 wt %, 5 wt %, 6, wt %, or 7 wt % of sulfur, as measured according to ASTM D4294-16e1. The first portion of the bottoms stream can have density of 1 g/cm$^3$, 1.05 g/cm$^3$, 1.07 g/cm$^3$, or 1.1 g/cm$^3$ to 1.13 g/cm$^3$, 1.15 g/cm$^3$, 1.17 g/cm$^3$, or 1.19 g/cm$^3$. The density can be measured according to ASTM D4052-18a. The first portion of the bottoms stream can have an API gravity at 15.6° C. of 1 or less. For example, the first portion of the bottoms stream can have an API gravity at 15.6° C. of −13, −10, −7, or −5 to −3, −1, 0, or 1. The API gravity can be measured according to ASTM D4052-18a. At least 75 wt % of the first portion of the bottoms stream can have a boiling point at atmospheric pressure of at least 300° C., 310° C., 320° C., 325° C., 330° C., 335° C., or 340° C. At least 25 wt % of the first portion of the bottoms stream can have a boiling point at atmospheric pressure of at least 490° C., 500° C., 510° C., 515° C., 520° C., 525° C., or 530° C. In certain embodiments, the bottoms stream can have a final atmospheric boiling point of greater than 600° C. The atmospheric boiling point can be measured according to ASTM D2887-18.

The first portion of the bottoms stream can have a 25/75 solubility number (25/75 SBN) of 0.6 wt %, 0.8 wt %, 1 wt %, 1.5 wt %, 2 wt %, or 3 wt % to 5 wt %, 6 wt %, 8 wt %, or 10 wt %. The 25/75 solubility number is measured by gravimetric separation according to the following procedure. On a weight basis, 1 part of the sample and 10 parts of the solvent is mixed overnight. The precipitated asphaltenes are then filtered, washed with additional solvent, and dried in a vacuum oven at 120° C. The wt % of insolubles is determined by weight the solid asphaltenes after drying. The solvent is a mixture that includes 25 wt % of heptane and 75 wt % of toluene.

The first portion of the bottoms stream can have an H-NMR analysis of 5%, 5.5%, or 6% to 6.5%, 7%, or 7.5%. The H-NMR value can be measured according to the following procedure. A known quantity of sample is weighed out in a sealed NMR vial and a proton signal is produced by the NMR. This signal is compared to a set of known standards to calculate the hydrogen percent of the sample. The viscosity of the sample can be reduced to less than 25 cSt by lending a solvent and back calculating the hydrogen percent of the sample.

The hydroprocessed bottoms stream can include less than 2 wt %, less than 1.5 wt %, less than 1 wt %, or less than 0.7 wt % of sulfur. For example, the hydroprocessed bottoms stream can include 0.1 wt %, 0.3 wt %, or 0.5 wt % to 0.7 wt %, 1 wt %, 1.5 wt %, or 1.7 wt % of sulfur. The hydroprocessed bottoms stream can have a density of 0.95 g/cm$^3$, 0.98 g/cm$^3$, 1 g/cm$^3$, 1.05 g/cm$^3$, 1.07 g/cm$^3$, or 1.1 g/cm$^3$. The hydroprocessed bottoms stream can have an API gravity at 15.6° C. of less than 3 or less. For example, the hydroprocessed bottoms stream can have an API gravity at 15.6° C. of −10, −5, −3, or −2 to −1, 0, 1, or 2. The hydroprocessed bottoms stream can have a 25/75 solubility number of 0 wt %, 0.3 wt %, 0.5 wt %, or 0.7 wt % to 1 wt %, 1.3 wt %, 1.5 wt %, 1.7 wt %, or 2 wt %. The hydroprocessed bottoms stream can have an H-NMR analysis value of 6.5%, 7%, or 7.5% to 8%, 9%, or 10%. At least 75 wt % of the hydroprocessed bottoms stream can have a boiling point at atmospheric pressure of at least 330° C., 340° C. 350° C., 355° C., 360° C., 365° C. or 370° C. At least 25 wt % of the hydroprocessed bottoms stream can have a boiling point at atmospheric pressure of at least 510° C., 520° C., 530° C., 535° C., 540° C., 545° C., or 550° C.

The first portion of the bottoms stream that includes the first portion of the tar can have a greater density and a greater 25/75 solubility number and include a greater amount of sulfur as compared to the hydroprocessed bottoms stream. The first portion of the bottoms stream can have an API gravity at 15.6° C. that is greater than an API gravity at 15.6° C. as compared to the hydroprocessed bottoms stream. The H-NMR analysis value of the first portion of the bottoms stream that includes the first portion of the tar can be less than the H-NMR analysis value of the hydroprocessed bottoms stream. The first portion of the bottoms stream can have a boiling point at atmospheric pressure for a given fraction that is greater than the hydroprocessed bottoms stream for the same given fraction. For example, 75 wt % of the first portion of the bottoms stream can have a boiling point at atmospheric pressure that is greater than the boiling point of 75 wt % of the hydroprocessed bottoms stream.

It can be desirable to cool the pyrolysis effluent quickly upon exiting the pyrolysis reactor, e.g., a radiant section of a stream cracker, to reduce the conversion of desirable products, e.g., olefins, into less desirable products, e.g., alkanes. As such, upon exiting the pyrolysis zone, the pyrolysis effluent can be contacted with the first quench medium, e.g., within a quench header or within an inlet into an indirect heat exchanger, e.g., a transfer line exchanger, within 100 milliseconds, 150 milliseconds, or 200 milliseconds to 300 milliseconds, 500 milliseconds, or 800 milliseconds, e.g., 100 milliseconds to 200 milliseconds, to produce the quenched effluent or the first quenched effluent. In certain embodiments, the pyrolysis effluent can be cooled within a quench header to a temperature of 450° C. to 550° C. by contacting the pyrolysis effluent with the first quench medium. In certain embodiments, the pyrolysis effluent can be cooled from a temperature of at least 750° C., e.g., 775° C. to 1,000° C., to the temperature of 450° C. to 550° C. within the quench header in 20 milliseconds, 30 milliseconds, or 40 milliseconds to 50 milliseconds, 75 milliseconds, or 100 milliseconds, e.g., 20 milliseconds to 40 milliseconds. In certain other embodiments, the pyrolysis effluent can be cooled within an indirect heat exchanger, e.g., a transfer line exchanger, to a temperature of 350° C. to 450° C. In certain embodiments, the pyrolysis effluent can be cooled from a temperature of at least 750° C., e.g., 775° C. to 1,100° C., to the temperature of 450° C. to 550° C. within the indirect heat exchanger in 100 milliseconds, 150 milliseconds, or 200 milliseconds to 300 milliseconds, 500 milliseconds, or 800 milliseconds, e.g., 100 milliseconds to 400 milliseconds.

After contacting the pyrolysis effluent with the first quench medium to produce the first quenched effluent, the first quenched effluent can be further cooled by one or more additional heat exchange stages. In certain embodiments, the first quenched effluent can be cooled by transferring heat from the first quenched effluent to a second quench medium, e.g., water, steam, or a mixture thereof, in an indirect heat exchanger, e.g., a transfer line exchanger. In certain other embodiments, the first quenched effluent can be cooled by contacting the first quenched effluent with a third quench medium, e.g., a quench oil separated from the pyrolysis effluent in a downstream separation stage. Any number of heat exchange stages, indirect heat exchange or by contact with a quench medium, can be used to produce the quenched effluent having a temperature of 250° C. to 350° C. or 275° C. to 325° C.

It has been surprisingly and unexpectedly discovered that the first quench medium that includes the first portion of the bottoms stream that includes the tar or the mixture of the first portion of the bottoms stream and the first portion of the hydroprocessed bottoms stream can provide significant advantages when used to cool pyrolysis effluents via direct contact. For example, at least a portion of the first quench medium can remain in a liquid phase when contacted with the pyrolysis effluent. In certain embodiments, at least 2 wt %, at least 3 wt %, at least 4 wt %, or at least 5 wt % to 7 wt %, 8.5%, or 10 wt % of the quench medium can remain in the liquid phase when contacted with the pyrolysis effluent. Without wishing to be bound by theory, it is believed that the fraction or portion of the quench medium that remains in a liquid phase when contacted with the pyrolysis effluent can flow along a surface of an inner wall of the quench header, transfer line exchanger, conduit, or other apparatus as the mixture flows therethrough. It is believed that the liquid fraction can "wash" or otherwise facilitate removal of at least a portion of any coke deposits, which can reduce, mitigate, delay, or even prevent fouling due to coke deposition.

In certain embodiments, a flow path of the mixture of the first quench medium and the pyrolysis effluent or the first quenched effluent through the indirect heat exchanger, e.g., a transfer line exchanger, can be in a downward direction. In certain other embodiments, the flow path of the mixture of the first quench medium and the pyrolysis effluent or the first quenched effluent through the indirect heat exchanger can be in an upward direction. In certain other embodiments, the flow path of the mixture of the first quench medium and the pyrolysis effluent or the first quenched effluent can flow through the indirect heat exchanger in a horizontal direction or any direction between horizontal and vertical with the flow traveling in an upward or downward direction if the flow path is not horizontal. In still certain other embodiments, the flow path of the mixture of the first quench medium and the pyrolysis effluent or the first quenched effluent through the indirect heat exchanger can include at least two of an upward direction, a downward direction, and a horizontal direction.

It has also been discovered that the hydroprocessed bottoms stream can serve as a substantially non-reactive solvent and hydrogen donor (H-donor) that can quench reactive species in the pyrolysis effluent and/or the virgin or non-hydroprocessed tar and reduce or prevent such reactive species from converting into heavier fouling species. In certain embodiments, the hydroprocessed bottoms stream can at least 0.3 wt %, at least 0.5 wt %, at least 0.7 wt %, at least 1 wt %, or at least 1.5 wt % of donatable hydrogen, based on the total weight of the hydroprocessed bottoms stream. Fouling within the indirect heat exchanger, e.g., a transfer line exchanger, can also increase pressure drop over time, which can affect the pyrolysis effluent yields. Since the bottoms stream that includes the tar or the mixture of the bottoms stream and the hydroprocessed bottoms stream can reduce, mitigate, delay, or even prevent fouling due to coke deposition within the indirect heat exchanger, it is also believed that the preferred pyrolysis effluent yields can be maintained for a longer period of time as compared to conventional pyrolysis processes that use quench oil recovered from a primary fractionator as a direct contact quench medium.

The concentration of the donatable hydrogen in a sample of the hydroprocessed bottoms stream can be determined by the following procedure. To a 20 mL scintillation vial in a glovebox is added 2,3-Dichloro-5,6-dicyano-1,4-benzoquinone (DDQ, 2.7 mmol) and about 8 mL toluene. With rapid stirring, a sample of the hydroprocessed bottoms stream (about 100 mg) is added to the solution of DDQ. The vial is then sealed, and heated at about 110° C. for about 1 hour, during which time a precipitate forms. The heating is cut off, the vial is opened, and 9,10-dihydroanthracene (2.7 mmol)

in ~3 mL toluene is added to the vial. The vial is then sealed and heated at about 110° C. for about 2 hours, during which time more precipitate forms. After 2 hours, an aliquot of the mixture is taken, filtered through a glass frit to remove a solid residue, and the filtrate is retrieved. The filtrate is analyzed by Gas Chromatography Mass Spectrometry (GCMS) for % composition of 9,10-dihydroanthracene and anthracene to determine the wt % of hydrogen donatable by the hydroprocessed bottoms stream. The GC analyses of two duplicate samples give an average wt % of donatable hydrogen based on the total weight of the hydroprocessed bottoms stream sample.

It has also been surprisingly and unexpectedly discovered that by contacting the pyrolysis effluent with the first quench effluent, a length of a flow path through an indirect heat exchanger to be significantly extended over conventional systems. For example, the pyrolysis effluent produced from a heavy hydrocarbon-containing feed, e.g., Murban crude or a blend of Murban crude and one or more crude fractions, can be contacted within a quench header fluidly coupled to an indirect heat exchanger or within an inlet into an indirect heat exchanger and can flow through a substantially longer flow path through the indirect heat exchanger as compared to conventional processes. For example, a transfer line exchanger used in a conventional steam cracking process that produces 1,200 KTA of ethylene from a heavy hydrocarbon-containing feed, e.g., Murban, typically has a flow path therethrough of 10 m to 11.7 m. In contrast, when using the first quench medium as described herein, a transfer line exchanger having a flow path of at least 10 m up to 18.5 m can be used. As such, the length of the transfer line exchanger can be significantly increased over the conventional processes, which can allow for a greater amount of heat recovery from the pyrolysis effluent via the transfer line exchanger and a greater degree of cooling of the pyrolysis effluent.

By indirectly quenching the first quenched effluent in a transfer line exchanger having such an increased length as compared to conventional processes, a significant increase in the amount of heat transferred from the first quenched effluent to the second quench medium can be realized. For example, in a conventional steam cracking process that first cools the pyrolysis effluent in a transfer line exchanger to produce a first cooled effluent and then contacts the first cooled effluent with a quench oil recovered from a primary fractionator, the amount of heat recovered from the pyrolysis effluent is typically capable of generating only up to about 135 MW to about 140 MW of power via one or more turbines while quenching the pyrolysis effluent to a temperature of only 625° C. to 725° C. when producing about 1,200 KTA of ethylene by steam cracking a given hydrocarbon-containing feed. In contrast, the amount of heat that can be recovered during quenching of the first quenched effluent when the first quench medium described herein is used can be sufficient to generate at least 150 MW, at least 175 MW, at least 200 MW, at least 225 MW, or at least 240 MW of power via one or more turbines while quenching the pyrolysis effluent to a temperature of 350° C. to 450° C. when producing about 1,200 KTA of ethylene from the same hydrocarbon-containing feed.

In certain embodiments, the pyrolysis effluent can be contacted with the first quench medium within a quench header to produce the first cooled effluent. The first cooled effluent can be at a temperature of about 475° C. to 550° C. Heat can be indirectly transferred from the first cooled effluent to a second quench medium, e.g., steam, water, or a mixture thereof, to produce a second quenched effluent. The second quenched effluent can be at a temperature of about 350° C. to 450° C. In certain embodiments, the second quenched effluent can be contacted with a third quench medium, e.g., a quench oil separated from the pyrolysis effluent in a downstream processing stage, to produce a third quenched effluent. In certain other embodiments, heat can be indirectly transferred from the second quenched effluent to a third quench medium, e.g., a steam and/or water, to produce the third quenched effluent. The third quenched effluent can be at a temperature of 250° C. to 350° C. An overhead stream and a bottoms stream can be obtained from the third quenched effluent. The overhead stream can include ethylene, propylene, and the quench oil. In certain embodiments, a first portion of the bottoms stream that includes tar can be recycled as the first quench medium. In certain other embodiments, a second portion of the bottoms stream that includes tar can be hydroprocessed to produce the hydroprocessed product from which the hydroprocessed bottoms can be obtained and a first portion of the hydroprocessed bottoms stream can also be recycled and make up a portion of the first quench medium.

In certain other embodiments, the pyrolysis effluent can be contacted with the first quench medium within an inlet to an indirect heat exchanger, e.g., a transfer line exchanger, to produce the first cooled effluent. Heat can be indirectly transferred from the first cooled effluent to a second quench medium, e.g., steam, water, or a mixture thereof, within the indirect heat exchanger to produce a second cooled effluent and a heated second quench medium. The second quenched effluent can be at a temperature of 350° C. to 450° C. In certain embodiments, the second quenched effluent can be contacted with a third quench medium, e.g., a quench oil separated from the pyrolysis effluent in a downstream processing stage, to produce a third quenched effluent. In certain other embodiments, heat can be indirectly transferred from the second quenched effluent to a third quench medium, e.g., a steam and/or water, to produce the third quenched effluent. The third quenched effluent can be at a temperature of 250° C. to 350° C. From the third quenched effluent the overhead stream and the bottoms stream can be obtained from the third quenched effluent. The overhead stream can include ethylene, propylene, and the quench oil. In certain embodiments, a first portion of the bottoms stream that includes tar can be recycled as the first quench medium. In certain other embodiments, a second portion of the bottoms stream that includes tar can be hydroprocessed to produce the hydroprocessed product from which the hydroprocessed bottoms can be obtained and a first portion of the hydroprocessed bottoms stream can also be recycled and make up a portion of the first quench medium.

Hydroprocessing the Bottoms Stream

The second portion of the bottoms stream can be subjected to hydroprocessing conditions sufficient to produce a hydroprocessed product from which the hydroprocessed bottoms stream can be obtained. In certain embodiments, the hydroprocessing conditions can be or can include a solvent-assisted tar conversion ("SATC") process. The hydroprocessing conditions can be sufficient to convert at least a portion of the tar in the first portion of the bottoms stream into lighter products similar to fuel oil. In certain embodiments, it can be desirable to further upgrade the tar to increase the content of compounds having normal boiling points in the distillate range. The solvent-assisted tar conversion processes can be effective for drastic viscosity reduction from as high as about 500,000 cSt to about 15 cSt at 50° C. with more than 90% sulfur conversion. The prominent reaction types in a solvent-assisted tar conversion process can include, but are not limited to, hydrocracking, hydrodesulfurization, hydrodenitrogenation, thermal cracking, hydrogenation, oligomerization reactions, or any combination thereof.

In certain embodiments, the solvent-assisted tar conversion process can include a multi-stage hydrocarbon conversion process that can include, but is not limited to, optionally heat soaking the second portion of the bottoms stream, hydroprocessing the second portion of the bottoms stream in a first hydroprocessing zone by contacting the second portion of the bottoms stream with at least one hydroprocessing catalyst in the presence of molecular hydrogen and optionally a utility fluid under catalytic hydroprocessing conditions to convert at least a portion of the bottoms stream to the hydroprocessed product. In one or more separation stages an overhead stream that includes at least 1 wt % of the hydroprocessed product, a mid-cut stream that includes at least 20 wt % of the hydroprocessed product and having a boiling point distribution of about 120° C. to about 480° C. as measured according to ASTM D7500-15, and a bottoms stream that includes at least 20 wt % of the hydroprocessed product can be separated from the hydroprocessed product. At least a portion of the mid-cut stream can be recycled for use as the utility fluid in the first hydroprocessing zone.

In certain embodiments, a second portion of the hydroprocessed bottoms stream can be hydroprocessed in a second hydroprocessing zone by contacting the bottoms stream with at least one hydroprocessing catalyst in the presence of molecular hydrogen under catalytic hydroprocessing conditions to convert at least a portion of the second portion of the hydroprocessed bottoms stream to a second hydroprocessed product. In an alternative example, all of the first portion of the bottoms stream can be hydroprocessed in both the first hydroprocessing stage and the second hydroprocessing stage, and a hydroprocessed overhead, a hydroprocessed mid-cut, and a hydroprocessed bottoms stream can be separated therefrom. The multi-stage configuration provides a second stage (or final stage if more than two hydroprocessing stages are used) hydroprocessed product that has a sulfur content of 1.5 wt % or less, such as 1 wt % or less or 0.5 wt % or less based on the total weight of the second hydroprocessed product.

In certain embodiments, the first hydroprocessing stage can include a first set of hydroprocessing conditions. In certain embodiments, the second portion of the bottoms stream can be hydroprocessed at a temperature of 400° C. or less, a weight hour space velocity (WHSV) of at least 0.3 $hr^{-1}$ based on a weight of the second portion of the bottoms stream that is subjected to the first set of hydroprocessing conditions, a total pressure of at least 6 MPa, and in the presence of molecular hydrogen supplied at a rate of less than 534 standard cubic meters per cubic meter of the second portion of the bottoms stream.

In certain embodiments, a portion of the hydroprocessed bottoms stream separated from the first hydroprocessed product or the first hydroprocessed product can be subjected to a second set of hydroprocessing conditions. In certain embodiments, the second set of hydroprocessing conditions can include hydroprocessing the first hydroprocessed product or the hydroprocessed bottoms stream separated from the first hydroprocessed product at a temperature of at least 200° C., a weight hour space velocity (WHSV) of at least 0.3 $hr^{-1}$ based on a weight of the first hydroprocessed product or the hydroprocessed bottoms stream separated from the first hydroprocessed product subjected to the second hydroprocessing, a total pressure of at least 6 MPa, and in the presence of molecular hydrogen supplied at a rate of at least 534 standard cubic meters per cubic meter of the first hydroprocessed product or the hydroprocessed bottoms stream separated from the first hydroprocessed product subjected to the tar hydroprocessing. In certain embodiments, the WHSV the first hydroprocessed product or the hydroprocessed bottoms stream separated from the first hydroprocessed product is subjected to can be less than the WHSV the first portion of the bottoms stream is subjected to.

In certain embodiments, a first portion of the first hydroprocessed bottoms stream and/or a first portion of the second hydroprocessed bottoms stream can be used to make up a portion of the first quench medium. Illustrative processes and systems that can be used to hydroprocess the second portion of the bottoms stream that includes the tar can include those disclosed in U.S. Pat. Nos. 9,090,836; 9,637,694; and 9,777,227; and International Patent Application Publication No. WO 2018/111574.

Pyrolysis of the Hydrocarbon-Containing Feed

The hydrocarbon-containing feed, e.g., the vapor phase hydrocarbon-containing feed obtained from the separation zone, can be subjected to any of a number of pyrolysis processes to produce the pyrolysis effluent. In certain embodiments, the pyrolysis effluent can be produced by steam cracking the hydrocarbon-containing feed; contacting the hydrocarbon-containing feed with a plurality of heated particles having a temperature sufficiently high to enable pyrolysis of at least a portion of the hydrocarbon-containing feed; subjecting the hydrocarbon-containing feed to a coking process; or any combination thereof. The pyrolysis processes that can be used to pyrolyze the hydrocarbon-containing feed are well-known and understood to persons skilled in the art.

In certain embodiments, the steam cracking can be carried out in at least one steam cracking furnace that includes one or more radiant sections and one or more convection sections. Fired heaters, e.g., burners, are located in the radiant section and flue gas from combustion carried out with the fired heaters travel from the radiant section, through the convection section, and then away from the steam cracker furnace's flue gas outlet. The hydrocarbon feed can be preheated by indirect exposure to the flue gases in the convection section. The pre-heated hydrocarbon feed can be combined with steam to produce the steam cracker feed. The steam cracker feed can be subjected to additional preheating in the convection section. The pre-heated steam cracker feed can be transferred to the radiant section, where the steam cracker feed can indirectly be exposed to the combustion carried out by the burners.

The steam cracker feed can include steam in an amount of 10 wt % to 90 wt %, based on the combined weight of the hydrocarbon-containing feed and steam, with the remainder comprising (or consisting essentially of, or consisting of) the hydrocarbon-containing feed. In certain embodiments, the weight ratio of the steam to the hydrocarbon-containing feed can be 0.1:1 to 1:1, e.g., a ratio of 0.2:1 to 0.6:1.

Steam cracking conditions can include, e.g., exposing the mixture of the hydrocarbon-containing feed and steam to a temperature (measured at the pyrolysis effluent outlet in the radiant section) of at least 400° C., e.g., at a temperature of 400° C. to 900° C., and a pressure of at least 0.1 bar, for a steam cracking residence time of 0.01 second to about 5.0 seconds. In certain embodiments, the mixture of the hydrocarbon-containing feed and steam can be exposed to a temperature sufficient to produce a pyrolysis effluent having a temperature of at least 750° C., at least 775° C., at least 800° C., or at least 825° C. to 850° C., 875° C., or 900° C. In certain other embodiments, the mixture of the hydrocarbon-containing feed and steam can be exposed to a temperature sufficient to produce a pyrolysis effluent having a temperature of at least 760° C., at least 800° C., at least 850° C., or at least 900° C. to 950° C., 1,000° C., or 1,100° C.

In certain embodiments, the steam cracking process can also include a separation zone, e.g., a K-pot, which can separate a heated hydrocarbon-containing feed into a liquid phase hydrocarbon-containing stream and a vapor phase hydrocarbon-containing stream, with the vapor phase hydrocarbon-containing stream being subjected to pyrolysis conditions sufficient to produce the pyrolysis effluent. It has also been discovered that the first quench medium that includes the first portion of the bottoms stream that includes the first portion of the tar and/or the mixture of the first portion of the bottoms stream and the first portion of the hydroprocessed bottoms stream can allow the separation zone to operate at an increased cut point temperature, which can enable a reduced hydrocarbon-containing feed rate while still producing the same amount of desired end products, e.g., ethylene and/or propylene. As such, the quench medium can enable an increased amount of a given hydrocarbon-containing feed to be converted to valuable products, e.g., ethylene and propylene. In certain embodiments, the amount of the hydrocarbon-containing feed, e.g., Arabian Light, can be increased from the 65 wt % in the conventional steam cracking process to at least 68 wt %, at least 70 wt %, at least 71 wt %, at least 73 wt %, at least 75 wt %, or at least 77 wt %. In certain embodiments, a separation zone in a steam cracking pyrolysis process, can be operated at a cut point temperature of at least 350° C., at least 400° C., at least 450° C., at least 475° C., at least 500° C., at least 515° C., at least 530° C., or at least 550° C. In certain embodiments, suitable steam cracking processes can include those described in U.S. Pat. Nos. 6,419,885; 6,632,351; 7,090,765; 7,097,758; 7,138,047; 7,220,887; 7,235,705; 7,244,871; 7,247,765; 7,297,833; 7,311,746; 7,312,371; 7,351,872; 7,488,459; 7,578,929; and 7,820,035; 7,993,435; 9,637,694; and 9,777,227; and U.S. Patent Application Publication No. 2015/0315494.

In certain other embodiments, the pyrolysis effluent can be produced by contacting the hydrocarbon-containing feed with a plurality of heated particles having a temperature sufficiently high to enable pyrolysis of at least a portion of the hydrocarbon-containing feed. In certain embodiments, the hydrocarbon-containing feed can be heated, e.g., via indirect heat exchange with a heated medium, to a temperature in a range from 100° C., 150° C., or 200° C. to 300° C., 350° C., or 400° C., e.g., 250° C. to 300° C., prior to feeding the hydrocarbon-containing feed into a pyrolysis zone. The plurality of fluidized particles can also be introduced, supplied, or otherwise fed into the pyrolysis zone. The plurality of fluidized particles can have a first temperature when fed into the pyrolysis zone. The first temperature can be sufficiently high to enable pyrolysis of at least a portion of the hydrocarbon-containing feed on contacting the particles within the pyrolysis zone. The pyrolysis effluent can be recovered from the pyrolysis zone and the particles can be separated therefrom, e.g., via a cyclone separator, and the pyrolysis effluent can be contacted with the first quench medium to produce the first quenched effluent.

In certain other embodiments, the plurality of fluidized particles can include an oxide of a transition metal element capable of oxidizing molecular hydrogen (H 2) at the first temperature. In this example, contacting at least a portion of the hydrocarbon-containing feed with the particles in the pyrolysis reaction zone to effect pyrolysis of at least a portion of the hydrocarbon-containing feed can produce a pyrolysis effluent that can include olefins, hydrogen, and the particles, where at least a portion of the transition metal element in the particles in the pyrolysis effluent is at a reduced state compared to the transition metal element in the particles fed into the pyrolysis reaction zone. The particles can be separated from the pyrolysis effluent, heated and oxidized in a combustion zone such that at least a portion of the transition metal element in the particles is oxidized to a higher oxidation state compared to the transition metal element in the particles in the pyrolysis effluent, and recycled to the pyrolysis zone. Suitable pyrolysis processes that utilize heated particulates to pyrolysis the hydrocarbon-containing feed can include those described in U.S. Pat. Nos. 3,163,496; 4,323,446; 4,828,681; 5,952,539; 6,179,993; and 8,361,311; and U.S. Patent Application Publication No. 2012/012581.

Coking processes can typically be categorized as delayed coking or fluidized bed coking, Fluidized bed coking is a petroleum refining process in which the hydrocarbon-containing feed is converted to lighter, more useful products by thermal decomposition (coking) at elevated reaction temperatures, typically about 480° C. to 590° C., and in most cases from 500° C. to 550° C. Fluidized coking can be carried out in a unit with a large reactor containing hot coke particles that are maintained in the fluidized condition at the required reaction temperature with steam injected at the bottom of the vessel with the average direction of movement of the coke particles being downwards through the bed. The hydrocarbon-containing feed can be heated to a pumpable temperature, typically in the range of 350° C. to 400° C., mixed with atomizing steam, and fed through multiple feed nozzles arranged at several successive levels in the reactor. Steam can be injected into a stripping section at the bottom of the reactor and can pass upward through the coke particles descending through the dense phase of the fluid bed in the main part of the reactor above the stripping section. Part of the feed liquid coats the coke particles in the fluidized bed and is subsequently cracked into layers of solid coke and lighter products which evolve as gas or vaporized liquid. Reactor pressure can be relatively low to favor vaporization of the hydrocarbon vapors which pass upwards from dense phase into dilute phase of the fluid bed in the coking zone and into cyclones at the top of the coking zone where most of the entrained solids are separated from the gas phase by centrifugal force in one or more cyclones and returned to the dense fluidized bed by gravity through the cyclone diplegs. The mixture of steam and hydrocarbon vapors (pyrolysis effluent) from the reactor is subsequently discharged from the cyclone gas outlets into a scrubber section in a plenum located above the coking zone and separated from it by a partition. It can be quenched in the scrubber section by contact with the first quench medium descending over sheds. A pump-around loop can circulate condensed liquid to an external cooler and back to the top shed row of the scrubber section to provide cooling for the quench medium and condensation of the heaviest fraction of the liquid product. This heavy fraction is typically recycled to extinction by feeding back to the coking zone in the reactor.

The coke particles formed in the coking zone pass downwards in the reactor and leave the bottom of the reactor vessel through a stripper section where they are exposed to steam in order to remove occluded hydrocarbons. The solid coke from the reactor, consisting mainly of carbon with lesser amounts of hydrogen, sulfur, nitrogen, and traces of vanadium, nickel, iron, and other elements derived from the feed, passes through the stripper and out of the reactor vessel to a burner or heater where it is partly burned in a fluidized bed with air to raise its temperature from about 480° C. to 700° C. to supply the heat required for the endothermic coking reactions, after which a portion of the hot coke particles is recirculated to the fluidized bed reaction zone to transfer the heat to the reactor and to act as nuclei for the coke formation. The balance is withdrawn as coke product. The net coke yield is only about 65 percent of that produced by delayed coking.

The Flexicoking™ process, developed by Exxon Research and Engineering Company, is a variant of the fluid coking process that is operated in a unit including a reactor and a heater, but also including a gasifier for gasifying the coke product by reaction with an air/steam mixture to form a low heating value fuel gas. A stream of coke passes from the heater to the gasifier where all but a small fraction of the coke is gasified to a low-BTU gas ($^{18}$ 120 BTU/standard cubic feet) by the addition of steam and air in a fluidized bed in an oxygen-deficient environment to form fuel gas comprising carbon monoxide and hydrogen. In a conventional Flexicoking™ configuration, the fuel gas product from the gasifier, containing entrained coke particles, is returned to the heater to provide most of the heat required for thermal cracking in the reactor with the balance of the reactor heat requirement supplied by combustion in the heater. A small amount of net coke (about 1 percent of feed) is withdrawn from the heater to purge the system of metals and ash. The liquid yield and properties are comparable to those from fluid coking. The fuel gas product is withdrawn from the heater following separation in internal cyclones which return coke particles through their diplegs.

The Flexicoking™ process is described in patents of Exxon Research and Engineering Company, including, for example, U.S. Pat. Nos. 3,661,543; 3,759,676; 3,816,084; 3,702,516; and 4,269,696. A variant is described in U.S. Pat. No. 4,213,848 in which the heat requirement of the reactor coking zone is satisfied by introducing a stream of light hydrocarbons from the product fractionator into the reactor instead of the stream of hot coke particles from the heater. Another variant is described in U.S. Pat. No. 5,472,596 using a stream of light paraffins injected into the hot coke return line to generate olefins. Early work proposed units with a stacked configuration but later units have migrated to a side-by-side arrangement. In certain embodiments, additional coking processes can include, but are not limited to the coking processes described in U.S. Pat. Nos. 6,860,985; 7,914,668; 8,101,066; 8,147,676; 8,496,805; 9,139,781; 9,670,417; 10,400,177; and 10,421,915.

FIG. 1 depicts an illustrative system 100 for converting a hydrocarbon-containing feed in line 101 by pyrolysis and quenching a pyrolysis effluent in line 125 via a first quenching configuration, according to one or more embodiments. The system 100 can include, but is not limited to, one or more pyrolysis reactors, e.g., steam crackers, 110, one or more separation stages (four are shown) 120, 140, 150, and 180, one or more pre-quench stages 130, one or more heat exchange stages (two are shown) 135 and 145, and one or more hydroprocessing stages 170.

In certain embodiments, the hydrocarbon-containing feed in line 101 and steam via line 102 can be mixed, blended, combined, or otherwise contacted to produce a mixture via line 103 can be heated within a convection section 104 of the pyrolysis reactor 110 to produce a heated mixture via line 106. In certain embodiments, the hydrocarbon-containing feed in line 101 can be heated within the convection section 104 to produce a heated hydrocarbon-containing feed and the steam in line 102 can be mixed, blended, combined, or otherwise contacted with eh pre-heated hydrocarbon-containing feed to produce the mixture thereof. In certain embodiments, the mixture in line 103 can include about 10 wt % to about 95 wt % of the water and/or steam, based on a combined weight of the hydrocarbon-containing feed and the water and/or steam. In certain embodiments, the heated mixture in line 106 can be at a temperature of 200° C. to 585° C. The heated mixture via line 106 can be introduced into the first separation stage 120. In certain embodiments, the heated mixture in line 106 can be prepared as disclosed in U.S. Patent Application Publication No. 2015/0315494.

A vapor phase stream or "first vapor phase stream" via line 121 and a liquid phase steam or "first liquid phase stream" via line 123 can be obtained from the first separation stage 120. In certain embodiments, the first separation stage 120 can be operated at a cut point temperature of at least 350° C., at least 400° C., at least 450° C., at least 475° C., at least 500° C., at least 515° C., at least 530° C., or at least 550° C. In certain embodiments, the vapor phase stream can include at least 67 wt %, at least 70 wt %, at least 73 wt %, at least 75 wt %, at least 77 wt %, at least 80 wt %, at least 83 wt %, at least 85 wt %, at least 87 wt %, or at least 90 wt % of a total amount of hydrocarbons in the hydrocarbon-containing feed in line 101, based on the total weight of the hydrocarbon-containing feed. In certain embodiments, the first separation stage 120 can be or can include the separators and/or other equipment disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; 6,632,351; 7,578,929; and 7,235,705.

The first vapor phase stream in line 121 can be heated to a temperature of at least 400° C., e.g., a temperature of about 425° C. to about 825° C., in the convection section 104 and the heated mixture via line 124 can be introduced to a radiant section 108 of the steam cracker 110 to produce the pyrolysis effluent via line 125. In certain embodiments, additional water and/or steam can be mixed, blended, combined, or otherwise contacted with the first vapor phase stream in line 121 before introducing the vapor phase stream to the radiant section 108 of the steam cracker 110. The pyrolysis effluent in line 125 can be at a temperature of at least 750° C., e.g., 775° C. to 1,100° C. In certain embodiments, the first vapor phase stream in line 121 can be subjected to steam cracking according to the processes and systems disclosed in U.S. Pat. Nos. 6,419,885; 7,993,435; 9,637,694; and 9,777,227; and WO Publication No. WO 2018/111574.

The pyrolysis effluent in line 125 can be mixed, blended, combined, or otherwise contacted with a quench medium or first quench medium in line 161 to produce a cooled or first quenched effluent in line 131. For example, the pyrolysis effluent in line 125 can be contacted with the quench medium in line 161 within the pre-quench stage 130 and the pre-cooled or first quenched effluent via line 131 can be obtained therefrom. In certain embodiments, the pyrolysis effluent in line 125 can be at a temperature of at least 750° C., at least 775° C., or at least 800° C. to 815° C., 825° C., or 1,100° C. when initially contacted with the quench medium in line 161. In certain embodiments, the first quenched effluent in line 131 can be at a temperature of 450° C., 475° C., or 500° C. to 525° C., 550° C., or 575° C. The pyrolysis effluent in line 125, upon exiting the pyrolysis reactor 110, can be contacted with the first quench medium in line 161 within 100 milliseconds, 150 milliseconds, or 200 milliseconds to 300 milliseconds, 500 milliseconds, or 800 milliseconds, e.g., 100 milliseconds to 200 milliseconds, to produce the pre-quenched effluent in line 131. In some embodiments, the pre-quench stage 130 can be or can include a quench header such as those disclosed in U.S. Pat.

Nos. 7,780,843; and 8,177,200. In certain embodiments, a weight ratio of the first quench medium to the pyrolysis effluent in the first quenched effluent in line 131 can be about 1:1, 1.3:1, 1.5:1, or 1.7:1 to 2:1, 2.5:1, 3:1, or 3.5:1.

As discussed above, the first quench medium in line 161 can provide several surprising an unexpected benefits. For example, at least 3 wt %, e.g., 5 wt % to 7 wt %, or 10 wt %%, of the quench medium can remain in a liquid phase and can flow along an inner surface of the conduit, heat exchanger, etc. to remove coke that can deposit thereon, thereby significantly decreasing or preventing fouling within the equipment through and/or within which the pyrolysis effluent or fractions thereof flow through. The quench medium in line 161 also can allow for a longer heat exchanger, e.g., a transfer line exchanger having an extended length as compared to conventional transfer line exchangers, which can allow for further quenching of the pyrolysis effluent and the recovery of additional heat as compared to conventional systems that use quench oil or other conventional quench mediums. The quench medium in line 161 can also allow for the separation stage 120 to be operated at an increased cut point temperature, which can substantially increase the amount of the hydrocarbon-containing feed in line 101 that can be introduced into the steam cracker 110 via the vapor phase stream in line 121.

The first quenched effluent via line 131 can be introduced into the heat exchange stage 135. As shown, the first quenched effluent via line 131 can be introduced into an indirect heat exchanger, e.g., a transfer line exchanger, 135. Within the indirect heat exchanger 135, heat can be indirectly transferred from the first quenched effluent to a second quench medium, e.g., water, steam, or a mixture thereof, introduced via line 134 into the indirect heat exchange stage 135 to produce a second quenched effluent via line 137 and a heated second quench medium via line 138.

The indirect heat exchange stage 135 can be sized such that sufficient heat can be transferred from the first quenched effluent to produce a second quenched effluent in line 137 having a temperature of 450° C. or less. For example, the second quenched effluent in line 137 can be at a temperature of 350° C., 360° C., or 370° C. to 400° C., 425° C., or 450° C. In certain embodiments, the amount of heat transferred from the first quenched effluent to the second quench medium can be sufficient to generate at least 150 MW, at least 175 MW, at least 200 MW, at least 225 MW, or at least 240 MW of power via one or more turbines while quenching the first quenched effluent to a temperature of 350° C. to 450° C. when producing about 1,200 KTA of ethylene from the hydrocarbon-containing feed. It should be understood that the amount of power that can be generated from the heated second quench medium in line 138 can decrease or increase based on the amount of hydrocarbon-containing feed being processed. The amount of power that can be generated from the second quench medium in line 138, however, can be significantly greater than a heated second quench medium in a conventional steam cracking process.

In certain embodiments, when the heat exchange stage 135 includes a transfer line exchanger, the transfer line exchanger can have a length that is significantly longer than conventional transfer line exchangers. In certain embodiments, the length of the transfer line exchanger, i.e., the length of the flow path the first quench effluent traverses through the transfer line exchanger, can be at least 10 m, at least 12 m, at least 14 m, at least 16 m, or at least 18 m. In contrast, conventional transfer line exchangers typically have a length of only 10 m to 11.7 m.

The second quenched effluent in line 137 and a third quench medium, e.g., a quench oil, via line 158 can be mixed, blended, or otherwise combined to produce a third quenched effluent via line 139. The third quenched effluent in line 139 can have a temperature of 250° C. to 350° C., e.g., 300° C. In certain embodiments, a weight ratio of the third quench medium to the second quenched effluent in the third quenched effluent in line 139 can be 0.5:1, 0.71, or 1:1 to 1.4:1, 1.7:1, or 2:1.

The third quenched effluent via line 139 can be introduced into the second separation stage, e.g., a vapor-liquid separator, 140. A bottoms stream or tar product via line 141 and an overhead or vapor phase stream via line 142 can be discharged or otherwise obtained from the second separation stage 140. The overhead via line 142 can be introduced into the third heat exchange stage, e.g., one or more indirect heat exchangers, 145 to produce a cooled overhead that can be discharged or otherwise obtained via line 146 from the third heat exchange stage 145. In certain embodiments, the cooled overhead can be at a temperature in a range of from 150° C., 165° C., 195° C., or 220° C. to 230° C., 250° C., 270° C., 285° C., 300° C., 315° C., 325° C., 335° C., or 350° C.

The cooled overhead via line 147 can be introduced into the fourth separation stage, e.g., a vapor-liquid separator such as a primary fractionator, 150. A plurality of products can be separated from the cooled overhead and discharged or otherwise obtained from the fourth separation stage 150. Illustrative products that can be separated from the cooled overhead in line 147 within the fourth separation stage 190 and discharged or otherwise obtained therefrom can include, but are not limited to, quench oil via line 151, gas oil via line 152, naphtha via line 153, and an overhead via line 154. The overhead via line 154 can be introduced into the fifth separation stage, e.g., a chill train, (not shown) and various light products such as molecular hydrogen, ethylene, and propylene can be separated therefrom. Other product can include, but are not limited to, methane, ethane, propane, butane, etc. As discussed above, in certain embodiments, at least a portion of the quench oil in line 151 can be combined via line 158 with the second quenched effluent in line 137 to produce the third quenched effluent in line 139. In certain embodiments, at least a portion of the quench oil in line 151 can be removed via line 156 from the system 100.

Returning to the bottoms stream in line 141, a first portion of the bottoms stream in line 141 can be introduced via line 161 to the quench header 130 as the first quench medium and can be contacted with the pyrolysis effluent therein to produce the first quenched effluent via line 131. In certain embodiments, a second portion of the bottoms stream in line 141 can be introduced via line 162 and molecular hydrogen via line 163 can be introduced into the hydroprocessing stage 170. A hydroprocessed product via line 175 can be discharged or otherwise obtained from the hydroprocessing stage 170. The second portion of the bottoms stream can be subjected to the hydroprocessing conditions discussed above within the hydroprocessing stage 170 to produce the hydroprocessed product via line 175.

The hydroprocessed product via line 175 can be introduced into the fourth separation stage, e.g., a vapor-liquid separator, 180. In certain embodiments, a hydroprocessed bottoms stream via line 181, a mid-cut solvent via line 182, and an overhead, e.g., molecular hydrogen, via line 183 can be discharged or otherwise obtained from the fourth separation stage 180. In certain embodiments, at least a portion of the mid-cut solvent via line 182 can be recycled to the hydroprocessing unit 170 as a utility fluid as discussed above. In certain embodiments, a first portion of the hydroprocessed bottoms in line 181 can be introduced via line 186 and mixed with the first portion of the bottoms stream in line 161 to produce the first quench medium. In certain embodiments, a second portion of the hydroprocessed bottoms in line 181 can be removed from the system 100 and/or introduced into one or more upgrading stages, e.g., a second hydroprocessing stage, via line 188.

In certain embodiments, at least a portion of the bottoms stream in line 123 can also be introduced into the hydroprocessing stage 170 along with the second portion of the bottoms stream in line 162 to produce the hydroprocessed product in line 175. In certain embodiments, at least a portion of the bottoms stream in line 123 can be removed from the system 100, upgraded via one or more additional processes, or a combination thereof.

Figure 2:
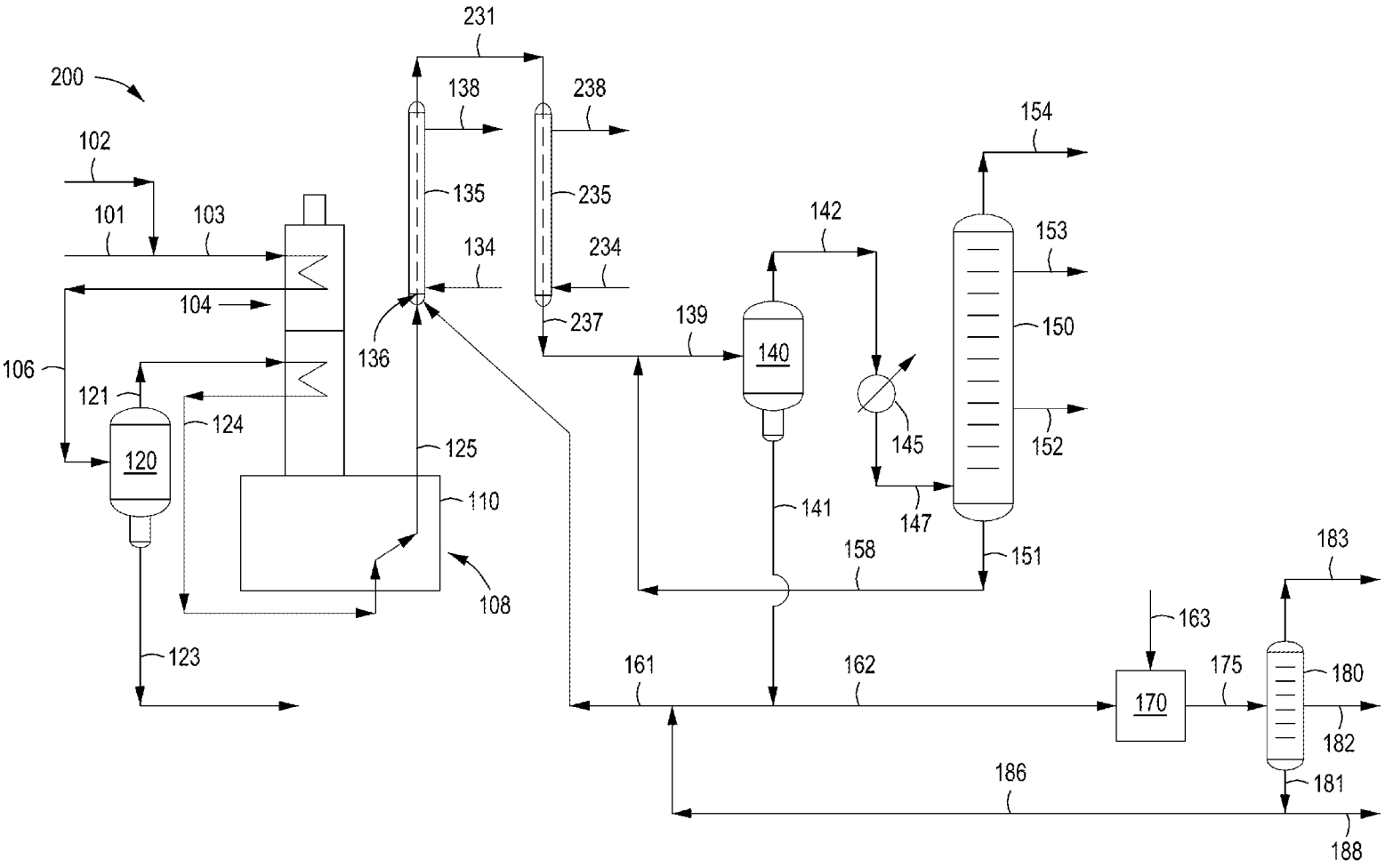
FIG. 2 depicts another illustrative system for converting a hydrocarbon-containing feed by pyrolysis to produce a pyrolysis effluent and quenching the pyrolysis effluent via a second quenching configuration, according to one or more embodiments described.

FIG. 2 depicts another illustrative system 200 for converting a hydrocarbon-containing feed 101 by pyrolysis to produce a pyrolysis effluent 125 and quenching the pyrolysis effluent via a second quenching configuration, according to one or more embodiments. The system 200 can be similar to the system 100, but can include a second quenching configuration as shown. More particularly, the pyrolysis effluent via line 125 and the first quench medium via line 161 can be directly introduced into an inlet of a first indirect heat exchanger, e.g., a first transfer line exchanger, and a first quenched effluent via line 231 can be discharged or otherwise obtained therefrom. While not shown, it should be understood that the pyrolysis effluent via line 125 and the first quench medium via line 161 can be introduced into a quench header 131 as described above with reference to FIG. 1. The first quenched effluent via line 231 can be introduced into a second indirect heat exchange stage, e.g., a second transfer line exchanger, 235 and the second quenched effluent via line 237 can be discharged or otherwise obtained therefrom. Heat can be indirectly transferred from the first quenched effluent to another quench medium introduced via line 234 to produce another heated quench medium via line 238.

In certain embodiments, the first heat exchange stage 135 and the second heat exchange stage 235 can be conventional transfer line heat exchangers. The mixture of the pyrolysis effluent and the first quench medium can serially flow through the first and second heat exchange stages 135,235 to produce the second quenched effluent via line 237. As shown, the mixture of the pyrolysis effluent and the first quench medium can flow in an upward direction through the first heat exchange stage 135 and can flow in a downward direction through the second heat exchange stage 235. In certain other embodiments, the mixture of the pyrolysis effluent and the first quench medium can flow in a downward direction through the first heat exchange stage 135 and can flow in an upward direction through the second heat exchange stage 235. In certain other embodiments, the mixture of the pyrolysis effluent and the first quench medium can flow through both the first heat exchange stage and the second heat exchange stage in an upward direction or in a downward direction. The second quenched effluent in line 237 can be further processed as described with reference to FIG. 1.

Figure 3:
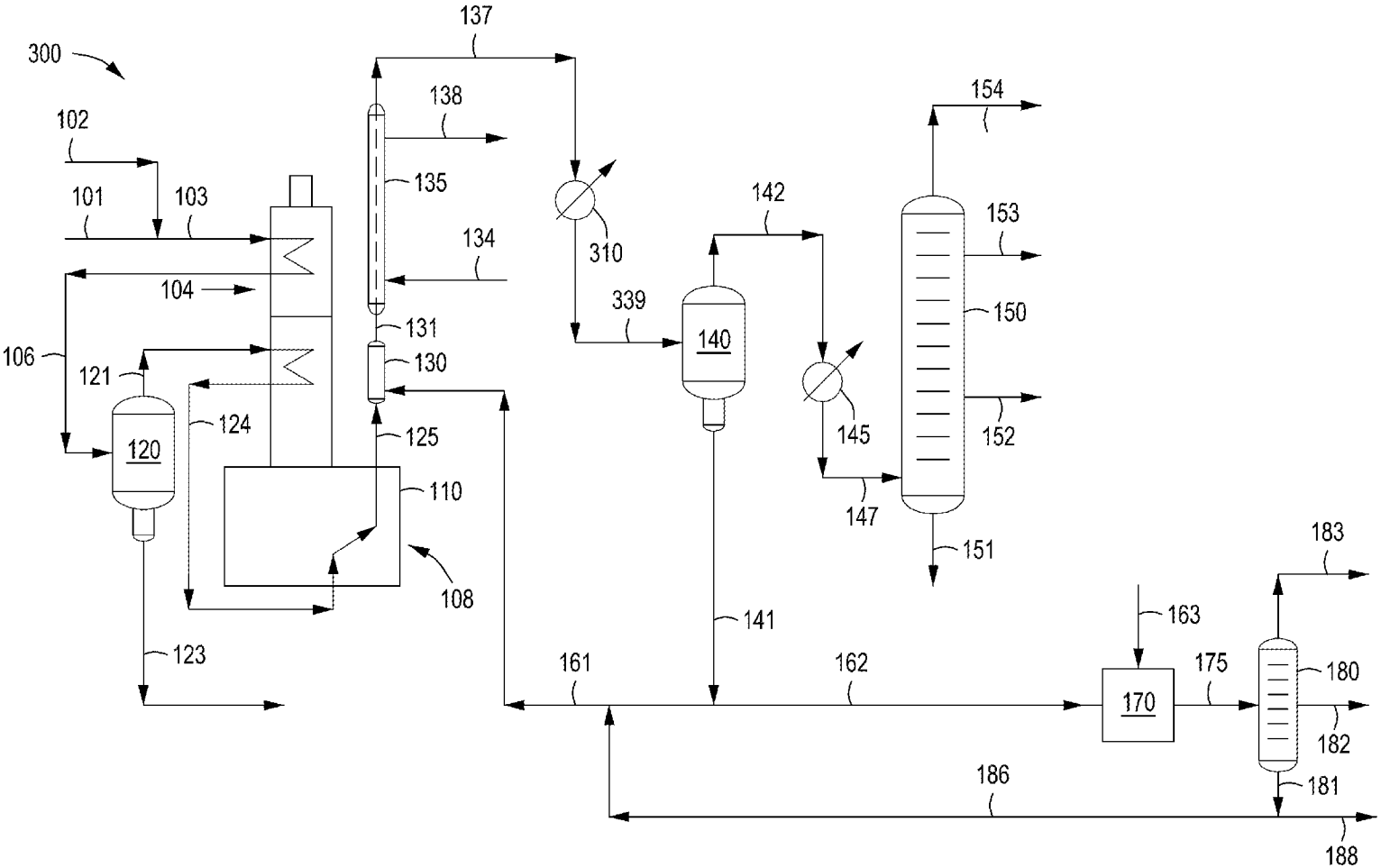
FIG. 3 depicts another illustrative system for converting a hydrocarbon-containing feed by pyrolysis to produce a pyrolysis effluent and quenching the pyrolysis effluent via a third quenching configuration, according to one or more embodiments described.

FIG. 3 depicts another illustrative system 300 for converting a hydrocarbon-containing feed in line 101 by pyrolysis to produce a pyrolysis effluent in line 125 and quenching the pyrolysis effluent via a third quenching configuration, according to one or more embodiments. The system 300 can be similar to the system 100, but can include a third quenching configuration as shown. More particularly, rather than contacting the second quenched effluent in line 137 with the quench oil in line 158, the second quenched effluent via line 137 can be introduced into an indirect heat exchange stage 310 to produce a third quenched effluent via line 339. The third quenched effluent in line 339 can be further processed as described with reference to FIG. 1.

Figure 4:
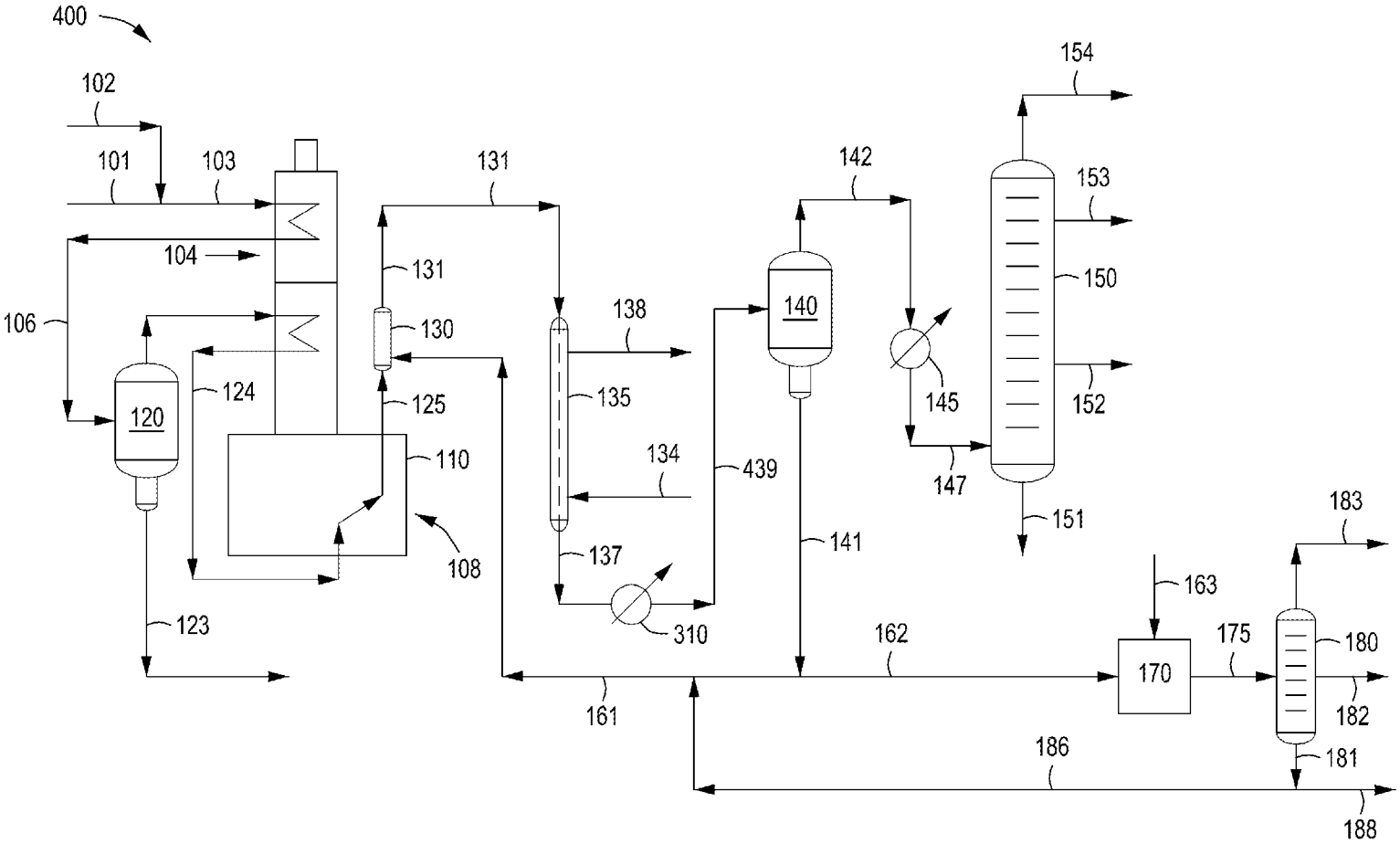
FIG. 4 depicts another illustrative system for converting a hydrocarbon-containing feed by pyrolysis to produce a pyrolysis effluent and quenching the pyrolysis effluent via a fourth quenching configuration, according to one or more embodiments described.

FIG. 4 depicts another illustrative system 400 for converting a hydrocarbon-containing feed in line 101 by pyrolysis to produce a pyrolysis effluent via line 125 and quenching the pyrolysis effluent via a fourth quenching configuration, according to one or more embodiments. The system 400 can be similar to the system 100, but can include a fourth quenching configuration as shown. More particularly, the first heat exchange stage 135 can be oriented such that the first quenched effluent introduced via line 131 thereto flows in a downward direction through the first heat exchange stage 135. The system 300 can also include the indirect heat exchange stage 310 described above with reference to FIG. 3 that can cool the second quenched effluent in line 137 to produce a third quenched effluent via line 439. In certain other embodiments, however, the third quench medium via line 158 described in FIG. 1 can be contacted with the second quenched effluent to produce the third quenched effluent via line 139. The third quenched effluent in line 439 or 139 can be further processed as described above with reference to FIG. 1.

LISTING OF EMBODIMENTS

This disclosure may further include the following non-limiting embodiments.

A1. A process for quenching an effluent, comprising: (I) contacting a pyrolysis effluent and a first quench medium to produce a first quenched effluent; and (II) obtaining from the first quenched effluent a bottoms stream comprising tar and an overhead stream comprising ethylene and propylene, wherein the first quench medium comprises a first portion of the bottoms stream comprising a first portion of the tar.

A2. The process of A1, further comprising: (III) hydroprocessing a second portion of the bottoms stream comprising a second portion of the tar to produce a hydroprocessed product; (IV) obtaining a hydroprocessed bottoms stream from the hydroprocessed product; and (IV) contacting at least a portion of the hydroprocessed bottoms stream and the first portion of the bottoms stream to produce the first quench medium.

A3. The process of A1 or A2, wherein at least 3 wt % of the first quench medium remains in a liquid phase when mixed with the pyrolysis effluent.

A4. The process of any of A1 to A3, wherein the pyrolysis effluent and the first quench medium flow through an indirect heat exchanger, and wherein the first quench medium in the liquid phase flows along a surface of an inner wall of the indirect heat exchanger.

A5. The process of A4, wherein the indirect heat exchanger comprises a transfer line exchanger.

A6. The process of A4 or A5, wherein the pyrolysis effluent and the first quench medium flow through the indirect heat exchanger in a downward direction.

A7. The process of A4 or A5, wherein the pyrolysis effluent the first quench medium flow through the indirect heat exchanger in an upward direction.

A8. The process of any of A2 to A7, wherein the first quench medium comprises about 10 wt % to about 90 wt % of the hydroprocessed bottoms stream, based on the combined weight of the hydroprocessed bottoms stream and the first portion of the bottoms stream.

A9. The process of any of A2 to A8, wherein the first quench medium comprises about 40 wt % to about 60 wt % of the hydroprocessed bottoms stream, based on the combined weight of the hydroprocessed bottoms stream and the first portion of the bottoms stream.

A10. The process of any of A1 to A9, wherein: the pyrolysis effluent and the first quench medium are contacted within a quench header or within an inlet of an indirect heat exchanger, the pyrolysis effluent has a temperature of at least 750° C., at least 3 wt % of the first quench medium remains in a liquid phase when contacted with the pyrolysis effluent, and at least a portion of the first quench medium in the liquid phase flows along a surface of an inner wall of the quench header or a surface of an inner wall of the indirect heat exchanger.

A11. The process of any of A1 to A10, wherein step (I) further comprises indirectly transferring heat from the first quenched effluent to a second quench medium to produce a second quenched effluent and a heated second quench medium, wherein the bottoms stream is obtained from the second quenched effluent.

A12. The process of A11, wherein: the pyrolysis effluent has a temperature of at least 750° C., the first quenched effluent has a temperature of 475° C. to 550° C., and the second quenched effluent has a temperature of less than 450° C.

A13. The process of A11 or A12, wherein an amount of heat transferred to the second quench medium is sufficient to generate at least 150 MW of power via a turbine.

A14. The process of any of A11 to A13, wherein step (I) further comprises contacting the second quenched effluent with a third quench medium to produce a third quenched effluent, wherein the bottoms stream is obtained from the third quenched effluent.

A15. The process of A14, wherein: the pyrolysis effluent has a temperature of at least 750° C., the first quenched effluent has a temperature of 475° C. to 550° C., the second quenched effluent has a temperature of 350° C. to 450° C., and the third quenched effluent has a temperature of 250° C. to 350° C.

A16. The process of A15, wherein the overhead stream further comprises a quench oil, wherein step (II) further comprises obtaining a process gas stream comprising the ethylene and the propylene and a quench oil stream comprising the quench oil, and wherein the third quench medium comprises at least a portion of the quench oil stream.

A17. The process of any of A2 to A16, wherein the hydroprocessing in step (III) comprises: hydroprocessing the second portion of the bottoms stream in a first hydroprocessing zone by contacting the second portion of the bottoms steam with at least one first hydroprocessing catalyst and molecular hydrogen under first catalytic hydroprocessing conditions to convert the second portion of the bottoms steam to a hydroprocessed product; obtaining from the first hydroprocessed product: (i) a hydroprocessed overhead stream comprising at least 1 wt % of the first hydroprocessed product; (ii) a hydroprocessed mid-cut stream comprising at least 20 wt % of the first hydroprocessed product; and (iii) the hydroprocessed bottoms stream, wherein the hydroprocessed bottoms stream comprises at least 20 wt % of the first hydroprocessed product, wherein a first portion of the hydroprocessed bottoms stream is contacted with the first portion of the bottoms stream to produce the first quench medium.

A18. The process of A17, further comprising hydroprocessing a second portion of the hydroprocessed bottoms stream in a second hydroprocessing zone by contacting the second portion of the hydroprocessed bottoms stream with at least one second hydroprocessing catalyst in the presence of molecular hydrogen under second catalytic hydroprocessing conditions to convert at least a portion of the second portion of the hydroprocessed bottoms stream to a second hydroprocessed product, wherein the second hydroprocessed product comprises less than 5,000 wppm of sulfur.

A19. The process of A17 or A18, wherein the hydroprocessed bottoms stream comprises at least 0.5 wt % of donatable hydrogen, based on the total weight of the hydroprocessed bottoms stream.

A20. The process of any of A17 to A19, wherein at least 75 wt % of the hydroprocessed bottoms stream has a boiling point at atmospheric pressure of at least 350° C. and at least 25 wt % of the hydroprocessed bottoms stream has a boiling point at atmospheric pressure of at least 530° C.

A21. The process of any of A2 to A20, wherein the hydroprocessed bottoms stream comprises less than 1.5 wt % of sulfur and has a density of at least 1 g/cm$^3$, an API gravity at 15.6° C. of less than 5, and a 25/75 solubility number of 0 wt % to 2 wt %.

A22. The process of any of A1 to A21, wherein the first portion of the bottoms stream comprising the first portion of the tar comprises at least 2.5 wt % of sulfur, has a density of at least 1.05 g/cm$^3$, an API gravity at 15.6° C. of less than 0, and a solubility number of 25/75 solubility number of 0.8 wt % to 10 wt %.

A23. The process of any of A2 to A22, wherein the first portion of the bottoms stream comprising the first portion of the tar has a greater density and a greater 25/75 solubility number and contains a greater amount of sulfur as compared to the hydroprocessed bottoms stream.

A24. The process of any of A2 to A23, wherein the first portion of the bottoms stream comprising the first portion of the tar has an API gravity at 15.6° C. that is greater than an API gravity at 15.6° C. as compared to the hydroprocessed bottoms stream.

A25. The process of any of A1 to A24, wherein the pyrolysis effluent is produced by: (a) steam cracking a hydrocarbon-containing feed, (b) contacting a hydrocarbon-containing feed with a plurality of heated particles having a temperature sufficiently high to enable pyrolysis of at least a portion of the hydrocarbon-containing feed; (c) subjecting a hydrocarbon-containing feed to a coking process; or (d) a combination thereof.

A26. The process of any of A1 to A25, wherein the hydrocarbon-containing feed comprises a resid.

A27. The process of any of A1 to A26, wherein the hydrocarbon feed comprises one or more plastic materials.

A28. The process of any of A1 to A27, wherein the hydrocarbon feed comprises crude oil or a fraction thereof.

B1. A process for quenching an effluent, comprising: (I) obtaining a vapor phase product and a liquid phase product from a heated mixture comprising steam and a hydrocarbon-containing feed; (II) steam cracking the vapor phase product to produce a pyrolysis effluent;

(III) contacting the pyrolysis effluent having a first temperature and a first quench medium to produce a first quenched effluent having a second temperature; (IV) indirectly transferring heat from the first quenched effluent to a second quench medium to produce a second quenched effluent having a third temperature and a heated second quench medium; (V) indirectly transferring heat from the second quenched effluent to a third quench medium or contacting the second quenched effluent with a third quench medium to produce a third quenched effluent having a fourth temperature; (VI) obtaining a bottoms stream comprising tar and an overhead stream comprising ethylene, propylene, and a quench oil from the third quenched effluent; and (VI) recycling a first portion of the bottoms stream comprising the tar as the first quench medium.

B2. The process of B1, further comprising: (VII) hydroprocessing a second portion of the bottoms stream comprising a second portion of the tar to produce a hydroprocessed product; and (VIII) recycling a first portion of the hydroprocessed product to provide a portion of the first quench medium.

B3. The process of B2, wherein the first portion of the bottoms stream and the first portion of the hydroprocessed product are contacted with one another to produce a mixture prior to contacting the pyrolysis effluent.

B4. The process of B2 or B3, wherein the first quench medium comprises about 10 wt % to about 90 wt % of the first portion of the hydroprocessed product, based on the combined weight of the first portion of the bottoms stream and the first portion of the hydroprocessed product.

B5. The process of any of B2 to B4, wherein the hydroprocessing in step (VII) comprises: hydroprocessing the second portion of the bottoms stream in a first hydroprocessing zone by contacting the second portion of the bottoms steam with at least one first hydroprocessing catalyst and molecular hydrogen under first catalytic hydroprocessing conditions to convert the second portion of the bottoms steam to a hydroprocessed product; obtaining from the first hydroprocessed product: (i) a hydroprocessed overhead stream comprising at least 1 wt % of the first hydroprocessed product; (ii) a hydroprocessed mid-cut stream comprising at least 20 wt % of the first hydroprocessed product; and (iii) a hydroprocessed bottoms stream, wherein the hydroprocessed bottoms stream comprises at least 20 wt % of the first hydroprocessed product, wherein the first portion of the hydroprocessed product recycled as the first quench medium comprises a first portion of the hydroprocessed bottoms stream.

B6. The process of any of B1 to B5, wherein an amount of heat transferred to the second quench medium is sufficient to generate at least 150 MW of power via one or more turbines B7. The process of any of B1 to B6, further comprising (IX) obtaining a process gas stream comprising the ethylene and the propylene and a quench oil stream comprising the quench oil from the overhead stream, wherein the second quenched effluent is contacted with the third quench medium to produce the third quenched effluent, and wherein the third quench medium comprises at least a portion of the quench oil stream.

B8. The process of any of B1 too B7, wherein at least 3 wt % of the first quench medium remains in a liquid phase when contacted with the pyrolysis effluent.

B9. The process of B8, wherein in step (IV) the first quenched effluent flows through an indirect heat exchanger to indirectly transfer the heat therefrom, and wherein the first quench medium in the liquid phase flows along a surface of an inner wall of the indirect heat exchanger.

B10. The process of B9, wherein the indirect heat exchanger comprises a transfer line exchanger.

B11. The process of B9 or B10, wherein the first quenched effluent flows through the indirect heat exchanger in a downward direction.

B12. The process of B9 or B10, wherein the first quenched effluent flows through the indirect heat exchanger in an upward direction.

B13. The process of any of B2 to B12, wherein the first quench medium comprises about 40 wt % to about 60 wt % of the hydroprocessed product, based on the combined weight of the hydroprocessed product and the bottoms stream.

B14. The process of any of B1 to B13, wherein the hydrocarbon-containing feed comprises a resid.

B15. The process of any of B1 to B14, wherein the hydrocarbon feed comprises one or more plastic materials.

B16. The process of any of B1 to B15, wherein the hydrocarbon feed comprises crude oil or a fraction thereof.

B17. The process of any of B2 to B16, wherein the hydroprocessed bottoms stream comprises less than 1.5 wt % of sulfur and has a density of at least 1 g/cm$^3$, an API gravity at 15.6° C. of less than 5, and a 25/75 solubility number of 0 wt % to 2 wt %.

B18. The process of any of B1 to B17, wherein the first portion of the bottoms stream comprising the first portion of the tar comprises at least 2.5 wt % of sulfur, has a density of at least 1.05 g/cm$^3$, an API gravity at 15.6° C. of less than 0, and a 25/75 solubility number of 0.8 wt % to 10 wt %.

C1. A system for converting a hydrocarbon-containing feed by pyrolysis, comprising: (i) a first vapor-liquid separator adapted for receiving a hydrocarbon-containing feed, separating the hydrocarbon-containing feed into a first vapor phase hydrocarbon stream and a first liquid phase hydrocarbon stream, discharging the first vapor phase hydrocarbon stream, and discharging the first liquid phase hydrocarbon stream; (ii) a pyrolysis reactor adapted for receiving the first vapor phase hydrocarbon stream, heating the first vapor phase hydrocarbon stream to effect pyrolysis of at least a portion of the first vapor phase hydrocarbon stream, and discharging a pyrolysis effluent stream; (iii) a quenching section adapted for receiving the pyrolysis effluent stream, quenching the pyrolysis effluent stream, and discharging a quenched pyrolysis effluent stream; (iv) a second vapor-liquid separator adapted for receiving the quenched pyrolysis effluent stream, separating the quenched pyrolysis effluent stream to obtain a second vapor phase hydrocarbon stream comprising olefins and a second liquid phase hydrocarbon stream comprising tar, discharging the second vapor phase hydrocarbon stream, and discharging the second liquid phase hydrocarbon stream; and (v) a first conduit adapted for transporting a first portion of the second liquid phase hydrocarbon stream comprising a first portion of the tar to the quenching section such that the first portion of the second liquid phase hydrocarbon stream contacts the pyrolysis effluent to produce a mixture comprising the first portion of the second liquid phase hydrocarbon stream and the pyrolysis effluent.

C2. The system of C1, further comprising: (vi) a hydroprocessing unit adapted for receiving a second portion of the second liquid phase hydrocarbon stream comprising a second portion of the tar and optionally at least a portion of the first liquid phase hydrocarbon stream, hydroprocessing the second portion of the second liquid phase hydrocarbon stream and optionally the at least a portion of the first liquid phase hydrocarbon stream under hydroprocessing conditions to produce a hydroprocessed product, and discharging the hydroprocessed product; (vii) a separator adapted for separating a hydroprocessed overhead stream comprising at least 1 wt % of the hydroprocessed product, a hydroprocessed mid-cut stream comprising at least 20 wt % of the hydroprocessed product; and a hydroprocessed bottoms stream comprising at least 20 wt % of the hydroprocessed product; (viii) a second conduit adapted for transferring at least a portion of the hydroprocessed bottoms stream from the separator to the quenching section such that the hydroprocessed bottoms stream contacts the pyrolysis effluent to produce a mixture comprising the first portion of the second liquid phase hydrocarbon stream, the pyrolysis effluent, and the hydroprocessed bottoms stream.

C3. The system of C2, wherein the first conduit and the second conduit are in fluid communication such that a mixture comprising the first portion of the bottoms stream comprising the first portion of the tar and the at least a portion of the hydroprocessed bottoms stream are contacted prior to contacting the pyrolysis effluent to produce the mixture comprising the first portion of the second liquid phase hydrocarbon stream, the pyrolysis effluent, and the hydroprocessed bottoms stream.

C4. The system of any of C1 to C3, wherein the quenching section comprises a transfer line exchanger, and wherein the transfer line exchanger is adapted to transfer heat from the pyrolysis effluent stream to a quench medium sufficient to generate at least 150 MW of power via one or more turbines.

C5. The system of any of C1 to C4, wherein the hydroprocessing unit is adapted to operate at hydroprocessing conditions sufficient to produce the first hydroprocessed product, and wherein the first hydroprocessed product has a concentration of donatable hydrogen of at least 0.5 wt % based on the total weight of the hydroprocessed product.

C6. The system of any of C1 to C5, wherein the quenching section comprises an indirect heat exchanger having a flow path therethrough such that the mixture comprising the first portion of the second liquid phase hydrocarbon stream and the pyrolysis effluent or mixture comprising the first portion of the second liquid phase hydrocarbon stream, the pyrolysis effluent, and the hydroprocessed bottoms stream flows downwardly through the indirect heat exchanger.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A process for quenching an effluent, comprising:

(I) contacting a pyrolysis effluent and a first quench medium to produce a first quenched effluent;

(II) indirectly transferring heat from the first quenched effluent to a second quench medium to produce a second quenched effluent and a heated second quench medium; and (III) obtaining from the second quenched effluent a bottoms stream comprising tar and an overhead stream comprising ethylene and propylene, wherein the first quench medium comprises a first portion of the bottoms stream comprising a first portion of the tar.

2. The process of claim 1, further comprising:

(IV) hydroprocessing a second portion of the bottoms stream comprising a second portion of the tar to produce a hydroprocessed product;

(V) obtaining a hydroprocessed bottoms stream from the hydroprocessed product; and (VI) contacting at least a portion of the hydroprocessed bottoms stream and the first portion of the bottoms stream to produce the first quench medium.

3. The process of claim 1, wherein at least 3 wt % of the first quench medium remains in a liquid phase when mixed with the pyrolysis effluent.

4. The process of claim 1, wherein the first quenched effluent and the second quench medium flow through an indirect heat exchanger in step (II), and wherein at least a portion of the first quench medium in the first quenched effluent is in a liquid phase and flows along a surface of an inner wall of the indirect heat exchanger.

5. The process of claim 4, wherein the indirect heat exchanger comprises a transfer line exchanger, and wherein the first quenched effluent flows through the indirect heat exchanger in a downward direction, an upward direction, or both.

6. The process of claim 2, wherein the first quench medium comprises about 10 wt % to about 90 wt % of the hydroprocessed bottoms stream, based on the combined weight of the hydroprocessed bottoms stream and the first portion of the bottoms stream.

7. The process of claim 1, wherein:

the pyrolysis effluent and the first quench medium are contacted within a quench header or within an inlet of an indirect heat exchanger, the pyrolysis effluent has a temperature of at least 750° C., at least 3 wt % of the first quench medium remains in a liquid phase when contacted with the pyrolysis effluent, and at least a portion of the first quench medium in the liquid phase flows along a surface of an inner wall of the quench header or a surface of an inner wall of the indirect heat exchanger.

8. The process of claim 1, wherein:

the pyrolysis effluent has a temperature of at least 750° C., the first quenched effluent has a temperature of 475° C. to 550° C., and the second quenched effluent has a temperature of less than 450° C.

9. The process of claim 1, wherein an amount of heat transferred to the second quench medium is sufficient to generate at least 150 MW of power via a turbine.

10. The process of claim 8, wherein step (II) further comprises contacting the second quenched effluent with a third quench medium to produce a third quenched effluent, wherein the bottoms stream is obtained from the third quenched effluent.

11. The process of claim 10, wherein:

the pyrolysis effluent has a temperature of at least 750° C., the first quenched effluent has a temperature of 475° C. to 550° C., the second quenched effluent has a temperature of 350° C. to 450° C., and the third quenched effluent has a temperature of 250° C. to 350° C.

12. The process of claim 11, wherein the overhead stream further comprises a quench oil, wherein step (III) further comprises obtaining a process gas stream comprising the ethylene and the propylene and a quench oil stream comprising the quench oil, and wherein the third quench medium comprises at least a portion of the quench oil stream.

13. The process of claim 2, wherein the hydroprocessing in step (IV) comprises:

hydroprocessing the second portion of the bottoms stream in a first hydroprocessing zone by contacting the second portion of the bottoms steam with at least one first hydroprocessing catalyst and molecular hydrogen under first catalytic hydroprocessing conditions to convert the second portion of the bottoms steam to a hydroprocessed product;

obtaining from the first hydroprocessed product:

(i) a hydroprocessed overhead stream comprising at least 1 wt % of the first hydroprocessed product;

(ii) a hydroprocessed mid-cut stream comprising at least 20 wt % of the first hydroprocessed product; and (iii) the hydroprocessed bottoms stream, wherein the hydroprocessed bottoms stream comprises at least 20 wt % of the first hydroprocessed product, and wherein a first portion of the hydroprocessed bottoms stream is contacted with the first portion of the bottoms stream to produce the first quench medium.

14. The process of claim 13, wherein the hydroprocessed bottoms stream comprises at least 0.5 wt % of donatable hydrogen, based on the total weight of the hydroprocessed bottoms stream.

15. The process of claim 2, wherein the first portion of the bottoms stream comprising the first portion of the tar comprises at least 2.5 wt % of sulfur, has a density of at least 1.05 g/cm$^3$, an API gravity at 15.6° C. of less than 0, and a 25/75 solubility number of 0.8 wt % to 10 wt %, and wherein the hydroprocessed bottoms stream comprises less than 1.5 wt % of sulfur and has a density of at least 1 g/cm$^3$, an API gravity at 15.6° C. of less than 5, and a 25/75 solubility number of 0 wt % to 2 wt %.

16. The process of claim 1, wherein the pyrolysis effluent is produced by:

(a) steam cracking a hydrocarbon-containing feed, (b) contacting a hydrocarbon-containing feed with a plurality of heated particles having a temperature sufficiently high to enable pyrolysis of at least a portion of the hydrocarbon-containing feed;

(c) subjecting a hydrocarbon-containing feed to a coking process; or (d) a combination thereof.

17. A process for quenching an effluent, comprising:

(I) obtaining a vapor phase product and a liquid phase product from a heated mixture comprising steam and a hydrocarbon-containing feed;

(II) steam cracking the vapor phase product to produce a pyrolysis effluent;

(III) contacting the pyrolysis effluent having a first temperature and a first quench medium to produce a first quenched effluent having a second temperature;

(IV) indirectly transferring heat from the first quenched effluent to a second quench medium to produce a second quenched effluent having a third temperature and a heated second quench medium;

(V) indirectly transferring heat from the second quenched effluent to a third quench medium or contacting the second quenched effluent with a third quench medium to produce a third quenched effluent having a fourth temperature;

(VI) obtaining a bottoms stream comprising tar and an overhead stream comprising ethylene, propylene, and a quench oil from the third quenched effluent; and (VII) recycling a first portion of the bottoms stream comprising the tar as the first quench medium.

18. The process of claim 17, further comprising:

(VIII) hydroprocessing a second portion of the bottoms stream comprising a second portion of the tar to produce a hydroprocessed product; and (IX) recycling a first portion of the hydroprocessed product to provide a portion of the first quench medium.

19. The process of claim 18, wherein the first portion of the bottoms stream and the first portion of the hydroprocessed product are contacted with one another to produce a mixture prior to contacting the pyrolysis effluent.

20. The process of claim 18, wherein the first quench medium comprises about 10 wt % to about 90 wt % of the first portion of the hydroprocessed product, based on the combined weight of the first portion of the bottoms stream and the first portion of the hydroprocessed product.

21. The process of claim 18, wherein the hydroprocessing in step (VIII) comprises:

hydroprocessing the second portion of the bottoms stream in a first hydroprocessing zone by contacting the second portion of the bottoms steam with at least one first hydroprocessing catalyst and molecular hydrogen under first catalytic hydroprocessing conditions to convert the second portion of the bottoms steam to a hydroprocessed product; and obtaining from the first hydroprocessed product:

(i) a hydroprocessed overhead stream comprising at least 1 wt % of the first hydroprocessed product;

(ii) a hydroprocessed mid-cut stream comprising at least 20 wt % of the first hydroprocessed product; and (iii) a hydroprocessed bottoms stream comprising at least 20 wt % of the first hydroprocessed product, wherein the first portion of the hydroprocessed product recycled as the first quench medium comprises a first portion of the hydroprocessed bottoms stream.

22. The process of claim 17, wherein at least 3 wt % of the first quench medium remains in a liquid phase when contacted with the pyrolysis effluent.

23. The process of claim 22, wherein in step (IV) the first quenched effluent flows through an indirect heat exchanger to indirectly transfer the heat therefrom, wherein at least a portion of the first quench medium in the first quenched effluent is in a liquid phase and flows along a surface of an inner wall of the indirect heat exchanger, and wherein the first quenched effluent flows through the indirect heat exchanger in a downward direction, an upward direction, or both.

24. The process of claim 17, wherein the first quench medium comprises about 40 wt % to about 60 wt % of the hydroprocessed product, based on the combined weight of the hydroprocessed product and the bottoms stream.

25. A system for converting a hydrocarbon-containing feed by pyrolysis, comprising:

(i) a first vapor-liquid separator adapted for receiving a hydrocarbon-containing feed, separating the hydrocarbon-containing feed into a first vapor phase hydrocarbon stream and a first liquid phase hydrocarbon stream, discharging the first vapor phase hydrocarbon stream, and discharging the first liquid phase hydrocarbon stream;

(ii) a pyrolysis reactor adapted for receiving the first vapor phase hydrocarbon stream, heating the first vapor phase hydrocarbon stream to effect pyrolysis of at least a portion of the first vapor phase hydrocarbon stream, and discharging a pyrolysis effluent stream;

(iii) a quenching section adapted for receiving the pyrolysis effluent stream, quenching the pyrolysis effluent stream, and discharging a quenched pyrolysis effluent stream;

(iv) a second vapor-liquid separator adapted for receiving the quenched pyrolysis effluent stream, separating the quenched pyrolysis effluent stream to obtain a second vapor phase hydrocarbon stream comprising olefins and a second liquid phase hydrocarbon stream comprising tar, discharging the second vapor phase hydrocarbon stream, and discharging the second liquid phase hydrocarbon stream; and (v) a first conduit adapted for transporting a first portion of the second liquid phase hydrocarbon stream comprising a first portion of the tar to the quenching section such that the first portion of the second liquid phase hydrocarbon stream contacts the pyrolysis effluent to produce a mixture comprising the first portion of the second liquid phase hydrocarbon stream and the pyrolysis effluent.

26. The system of claim 25, further comprising:

(vi) a hydroprocessing unit adapted for receiving a second portion of the second liquid phase hydrocarbon stream comprising a second portion of the tar and optionally at least a portion of the first liquid phase hydrocarbon stream, hydroprocessing the second portion of the second liquid phase hydrocarbon stream and optionally the at least a portion of the first liquid phase hydrocarbon stream under hydroprocessing conditions to produce a hydroprocessed product, and discharging the hydroprocessed product;

(vii) a separator adapted for separating a hydroprocessed overhead stream comprising at least 1 wt % of the hydroprocessed product, a hydroprocessed mid-cut stream comprising at least 20 wt % of the hydroprocessed product; and a hydroprocessed bottoms stream comprising at least 20 wt % of the hydroprocessed product;

(viii) a second conduit adapted for transferring at least a portion of the hydroprocessed bottoms stream from the separator to the quenching section such that the hydroprocessed bottoms stream contacts the pyrolysis effluent to produce a mixture comprising the first portion of the second liquid phase hydrocarbon stream, the pyrolysis effluent, and the hydroprocessed bottoms stream.

27. The system of claim 25, wherein the quenching section comprises a pre-quench stage configured to contact the pyrolysis effluent stream with the first portion of the second liquid phase hydrocarbon stream to produce the mixture and an indirect heat exchanger configured to indirectly transfer heat from the mixture to a second quench medium to produce the quenched pyrolysis effluent stream and a heated second quench medium.

* * * * *